US012751483B2

(12) United States Patent
Hepworth et al.

(10) Patent No.: US 12,751,483 B2
(45) Date of Patent: Oct. 6, 2026

(54) AEROSOL-GENERATING MATERIAL

(71) Applicant: Nicoventures Trading Limited, London (GB)

(72) Inventors: Richard Hepworth, London (GB); Benjamin Zainuddin, London (GB); Dominic Ow, London (GB); Thomas Woodman, London (GB); William England, London (GB); Benjamin Jenkins, London (GB)

(73) Assignee: NICOVENTURES TRADING LIMITED, London (GB)

( * ) Notice: Subject to any disclaimer, the term of this patent is extended or adjusted under 35 U.S.C. 154(b) by 589 days.

(21) Appl. No.: 18/002,176

(22) PCT Filed: Jun. 16, 2021

(86) PCT No.: PCT/GB2021/051530
§ 371 (c)(1),
(2) Date: Dec. 16, 2022

(87) PCT Pub. No.: WO2021/255453
PCT Pub. Date: Dec. 23, 2021

(65) Prior Publication Data

US 2023/0240352 A1 Aug. 3, 2023

(30) Foreign Application Priority Data

Jun. 16, 2020 (GB) ..... 2009162

(51) Int. Cl.
*A24D 1/20* (2020.01)
*A24B 3/14* (2006.01)
(Continued)

(52) U.S. Cl.
CPC ..... *A24D 1/20* (2020.01); *A24B 3/14* (2013.01); *A24B 13/02* (2013.01); *A24B 15/14* (2013.01); *A24B 15/16* (2013.01); *A24F 40/20* (2020.01)

(58) Field of Classification Search
None
See application file for complete search history.

(56) References Cited

U.S. PATENT DOCUMENTS 3,872,871 A 3/1975 Fiore et al.
4,306,578 A 12/1981 Schmidt et al.
(Continued)

FOREIGN PATENT DOCUMENTS

CN 102504562 A 6/2012
CN 111000277 A 4/2020
(Continued)

OTHER PUBLICATIONS

International Search Report and Written Opinion for International Application No. PCT/GB2021/051530, mailed on Sep. 28, 2021, 11 pages.
(Continued)

*Primary Examiner* — Dennis R Cordray
(74) *Attorney, Agent, or Firm* — WOMBLE BOND DICKINSON (US) LLP

(57) ABSTRACT

An aerosol-generating material having a sheet or shredded sheet of aerosolizable material including tobacco material, an aerosol-former material and a binder, wherein the sheet or shredded sheet has a thickness of at least about 100 μm and an area density of from about 100 g/m2 to about 250 g/m2. A process of manufacturing the aerosol-generating material and an article including the aerosol-generating material are also disclosed.

9 Claims, 7 Drawing Sheets

(51) Int. Cl.

| | |
|---|---|
| ***A24B 13/02*** | (2006.01) |
| ***A24B 15/14*** | (2006.01) |
| ***A24B 15/16*** | (2020.01) |
| ***A24F 40/20*** | (2020.01) |

(56) References Cited

U.S. PATENT DOCUMENTS

| | | | | |
|---|---|---|---|---|
| 2015/0181938 | A1* | 7/2015 | Metrangolo | A24B 3/14 165/185 |
| 2021/0345659 | A1* | 11/2021 | Arndt | A24C 5/01 |

FOREIGN PATENT DOCUMENTS

| | | | |
|---|---|---|---|
| GB | 1517547 | A | 7/1978 |
| WO | 9406313 | A1 | 3/1994 |
| WO | 2013178768 | A1 | 12/2013 |
| WO | 2020025722 | A1 | 2/2020 |
| WO | 2020/074535 | A1 | 4/2020 |
| WO | 2020074494 | A1 | 4/2020 |
| WO | 2020012176 | A1 | 1/2022 |

OTHER PUBLICATIONS

English Translation of JP Office Action, dated Jan. 9, 2024, from related JP Application No. 2022-572579, 9 pages.

* cited by examiner

AEROSOL-GENERATING MATERIAL

PRIORITY CLAIM

The present application is a National Phase entry of PCT Application No. PCT/GB2021/051530, filed Jun. 16, 2021, which claims priority from GB Application No. 2009162.5, filed Jun. 16, 2020, each of which is hereby fully incorporated herein by reference.

TECHNICAL FIELD

The present disclosure relates to an aerosol-generating material, a method for manufacturing an aerosol-generating-material and an article comprising an aerosol-generating material for use in a non-combustible aerosol provision device.

BACKGROUND

Certain tobacco industry products produce an aerosol during use, which is inhaled by a user. For example, tobacco heating devices heat an aerosol-generating material such as tobacco to form an aerosol by heating, but not burning, the substrate. Such tobacco industry products commonly include mouthpieces through which the aerosol passes to reach the user's mouth.

SUMMARY

According to a first aspect of the disclosure, there is provided an aerosol-generating material comprising a sheet or shredded sheet of aerosolizable material comprising tobacco material, an aerosol-former material and a binder, wherein the sheet or shredded sheet has a thickness of at least about 100 μm and an area density of from about 100 $g/m^2$ to about 250 $g/m^2$.

In some embodiments, the sheet or the shredded sheet of aerosolizable material has an average thickness of from about 160 μm and about 290 μm.

The sheet or the shredded sheet of aerosolizable material may have a tensile strength of at least about 4 N/15 mm.

The sheet or the shredded sheet of aerosolizable material may have a burst strength of at least about 75 g.

The sheet or the shredded sheet of aerosolizable material may comprise a plurality of strands or strips of the aerosolizable material. The strands or strips of aerosolizable material may have a width of between about 0.9 mm and about 2 mm.

In some embodiments, the sheet or shredded sheet of aerosolizable material comprises water and the aerosol-former material in a total amount of less than about 30% by weight of the aerosolizable material.

In some embodiments, the tobacco material comprises lamina tobacco in an amount from about 50% to about 100% by weight of the aerosolizable material.

In some embodiments, the tobacco material comprises stem tobacco in an amount of up to about 15% by weight of the aerosolizable material.

The aerosol-former material may be present in an amount of from about 10% to about 25% by weight of the aerosolizable material.

In some embodiments, the tobacco material comprises particulate tobacco, wherein a population of the particulate tobacco has a particle size distribution (D90) of at least about 100 μm.

The aerosolizable material may comprise a filler. In some embodiments, the filler comprises a fibrous material. In some embodiments, the fibrous material comprises wood fibers.

According to a second aspect of the disclosure, there is provided an aerosolizable material comprising tobacco material, an aerosol-former material and a binder, wherein the sheet or shredded sheet has a thickness of at least about 100 μm and an area density of from about 100 $g/m^2$ to about 250 $g/m^2$.

According to any aspects of the disclosure, the aerosolizable material may not be crimped.

According to a third aspect of the disclosure a process for manufacturing an aerosol-generating material is provided, the process comprising combining tobacco material, an aerosol-former material, water and a binder to form a slurry and processing the slurry so as to form a sheet of aerosolizable material having a thickness of at least about 100 μm and an area density of from about 100 $g/m^2$ to about 250 $g/m^2$.

In some embodiments, the process comprises shredding the sheet to form a shredded sheet comprising a plurality of strips of the aerosolizable material.

In some embodiments, the step of processing the slurry comprises casting the sheet or extruding the slurry to form the sheet of aerosolizable material.

In some embodiments, the step of processing the slurry comprises casting the sheet on a band caster.

According to a fourth aspect of the disclosure, there is provided an aerosol-generating material produced according to the process of the third aspect.

According to a fifth aspect of the disclosure, there is provided a use of an aerosol-generating material as described in the first or fourth aspects in a non-combustible aerosol provision system.

According to a sixth aspect of the disclosure, there is provided an article for use in a non-combustible aerosol provision system, the article comprising the aerosol-generating material of the first or fourth aspects.

The article may comprise an aerosol-generating section comprising the aerosol-generating material.

In some embodiments, the aerosol-generating section comprises a wrapper circumscribing the aerosol-generating material.

In some embodiments, at least about 70% of a volume of the aerosol-generating section comprises the aerosol-generating material.

In some embodiments, the article is configured such that, in use, a pressure drop across the aerosol-generating section is from about 15 to about 40 mm $H_2O$.

In some embodiments, the aerosol-generating material has a packing density in the aerosol-generating section of between about 400 $mg/cm^3$ and about 900 $mg/cm^3$.

In some embodiments, the article is for use in a non-combustible aerosol provision device comprising an aerosol generator for insertion into the aerosol-generating section.

In some embodiments, the aerosol-generating section is configured to receive at least a portion of the aerosol generator.

In some embodiments, the article is configured such that, in use, when the aerosol generator is received by the article, the aerosol generator is in direct contact with at least a portion of the aerosol-generating material.

In some embodiments, the article is configured such that, in use, insertion of the aerosol generator into the aerosol-generating section increases the packing density of the aerosol-generating material.

In some embodiments, the article is configured such that, in use, insertion of the aerosol generator into the aerosol-generating section of the article requires a force of less than about 100 N.

In some embodiments, the wrapper comprises a wrapper material comprising a cellulose based material, wherein said cellulose based material has a basis weight greater than about 40 grams per square meter.

According to a seventh aspect of the disclosure, there is provided a non-combustible aerosol provision system comprising an article of the sixth aspect and a non-combustible aerosol provision device.

In some embodiments, the non-combustible aerosol provision device comprises an aerosol generator configured for insertion into the aerosol-generating section.

BRIEF DESCRIPTION OF THE DRAWINGS

Embodiments of the invention will now be described, by way of example only, with reference to the accompanying drawings, in which.

DETAILED DESCRIPTION OF THE DRAWINGS

Figure 1:
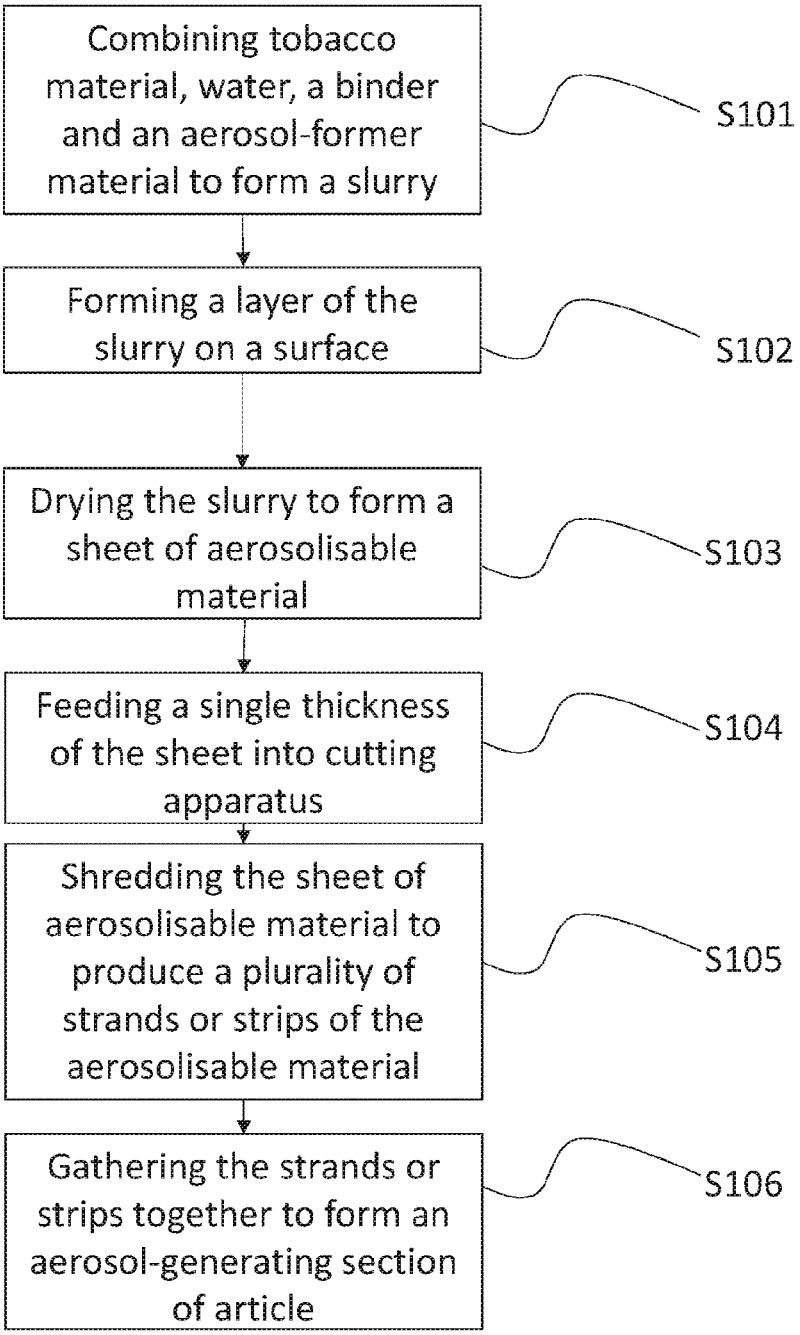
FIG. 1 depicts the steps of a process used to manufacture an article comprising an aerosol-generating material.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and
- aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

The terms 'upstream' and 'downstream' used herein are relative terms defined in relation to the direction of mainstream aerosol drawn through an article or device in use.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system comprises an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the consumable comprises a substance to be delivered. The substance to be delivered may be an aerosol-generating material or a material that is not intended to be aerosolized. As appropriate, either material may comprise one or more active constituents, one or more flavors, one or more aerosol-former materials, and/or one or more other functional materials.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine. In some embodiments, the active substance comprises caffeine, melatonin or vitamin B12.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from *eucalyptus*, star anise, cocoa and hemp.

In some embodiments, the active substance comprises or derived from one or more botanicals or constituents, derivatives or extracts thereof and the botanical is selected from rooibos and fennel.

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

An aerosol-generating material is a material that is capable of generating aerosol, for example when heated, irradiated or energized in any other way. An aerosol-generating material may be in the form of a solid, liquid or gel which may or may not contain an active substance and/or flavorants. The aerosol-generating material may be incorporated into an article for use in the aerosol-generating system.

As used herein, the term "tobacco material" refers to any material comprising tobacco or derivatives or substitutes thereof. The tobacco material may be in any suitable form. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, tobacco lamina, reconstituted tobacco and/or tobacco extract.

According to an aspect of the disclosure, there is provided an aerosol-generating material. The aerosol-generating material comprises a sheet or a shredded sheet of aerosolizable material. The aerosolizable material is arranged to generate aerosol when heated.

The sheet or shredded sheet comprises a first surface and a second surface opposite the first surface. The dimensions of the first and second surfaces are congruent. The first and second surfaces of the sheet or shredded sheet may have any shape. For example, the first and second surfaces may be square, rectangular, oblong or circular. Irregular shapes are also envisaged.

The first and/or second surfaces of the sheet or shredded sheet may be relatively uniform (e.g. they may be relatively smooth) or they may be uneven or irregular. For example, the first and/or second surfaces of the sheet may be textured or patterned to define a relatively coarse surface. In some embodiments, the first and/or second surfaces are relatively rough.

The smoothness of the first and second surfaces may be influenced by a number of factors, such as the area density of the sheet or shredded sheet, the nature of the components that make up the aerosolizable material or whether the surfaces of the material have been manipulated, for example embossed, scored or otherwise altered to confer them with a pattern or texture.

The areas of the first and second surfaces are each defined by a first dimension (e.g. a width) and a second dimension (e.g. a length). The measurements of the first and second dimensions may have a ratio of 1:1 or greater than 1:1 and thus the sheet or shredded sheet may have an "aspect ratio" of 1:1 or greater than 1:1. As used herein, the term "aspect ratio" is the ratio of a measurement of a first dimension of the first or second surface to a measurement of a second dimension of the first or second surface. An "aspect ratio of 1:1" means that a measurement of the first dimension (e.g. width) and a measurement of the second dimension (e.g. length) are identical. An "aspect ratio of greater than 1:1" a measurement of the first dimension (e.g. width) and a measurement of the second dimension (e.g. length) are different. In some embodiments, the first and second surfaces of the sheet or shredded sheet have an aspect ratio of greater than 1:1, such as 1:2, 1:3, 1:4, 1:5, 1:6, 1:7 or more.

The shredded sheet may comprise one or more strands or strips of the aerosolizable material. In some embodiments, the shredded sheet comprises a plurality (e.g. two or more) strands or strips of the aerosolizable material. The strands or strips of aerosolizable material may have an aspect ratio of 1:1. In an embodiment, the strands or strips of aerosolizable material have an aspect ratio of greater than 1:1. In some embodiments, the strands or strips of aerosolizable material have an aspect ratio of from about 1:5 to about 1:16, or about 1:5, 1:6, 1:7, 1:8, 1:9, 1:10, 1:11 or 1:12. Where the aspect ratio of the strands or strips is greater than 1:1, the strands or strips comprises a longitudinal dimension, or length, extending between a first end of the strand or strip and a second end of the strand or strip.

Where the shredded sheet comprises a plurality of strands or strips of material, the dimensions of each strand or strip may vary between different strands or strips. For example, the shredded sheet may comprise a first population of strands or strips and a second population of strands or strips, wherein the dimensions of the strands or strips of the first population are different to the dimensions of the strands or strips of the second population. In other words, the plurality of strands or strips may comprise a first population of strands or strips having a first aspect ratio and a second population of strands or strips having a second aspect ratio that is different to the first aspect ratio.

A first dimension, or cut width, of the strands or strips of aerosolizable material is between 0.9 mm and 1.5 mm. The inventors have found that, when strands or strips of aerosolizable material having a cut width of below 0.9 mm are incorporated into an article for use in a non-combustible aerosol provision system, the pressure drop across the article may be increased to a level that renders the article unsuitable for use in a non-combustible aerosol-provision device. However, if the strands or strips have a cut width above 2 mm (e.g. greater than 2 mm), then it may be challenging to insert the strands or strips of aerosolizable material into the article during its manufacture. In a preferred embodiment, the cut width of the strands or strips of aerosolizable material is between about 1 mm and 1.5 mm.

The strands or strips of material are formed by shredding the sheet of aerosolizable material. The sheet of aerosolizable material may be cut width-wise, for example in a cross-cut type shredding process, to define a cut length for the strands or strips of aerosolizable material, in addition to a cut width. The cut length of the shredded aerosolizable material is preferably at least 5 mm, for instance at least 10 mm, or at least 20 mm. The cut length of the shredded aerosolizable material can be less than 60 mm, less than 50 mm, or less than 40 mm.

In some embodiments, a plurality of strands or strips of aerosolizable material is provided and at least one of the plurality of strands or strips of aerosolizable material has a length greater than about 10 mm. At least one of the plurality of strands or strips of aerosolizable material can alternatively or in addition have a length between about 10 mm and about 60 mm, or between about 20 mm and about 50 mm. Each of the plurality of strands or strips of aerosolizable material can have a length between about 10 mm and about 60 mm, or between about 20 mm and about 50 mm.

The sheet or shredded sheet of aerosolizable material has a thickness of at least about 100 μm. The sheet or the shredded sheet may have a thickness of at least about 120 μm, 140 μm, 160 μm, 180 μm or 200 μm. In some embodiments, the sheet or shredded sheet has a thickness of from about 150 μm to about 300 μm, from about 151 μm to about 299 μm, from about 152 μm to about 298 μm, from about 153 μm to about 297 μm, from about 154 μm to about 296 μm, from about 155 μm to about 295 μm, from about 156 μm to about 294 μm, from about 157 μm to about 293 μm, from about 158 μm to about 292 μm, from about 159 μm to about 291 μm or from about 160 μm to about 290 μm. In some embodiments, the sheet or shredded sheet has a thickness of from about 170 μm to about 280 μm, from about 180 to about 270 μm, from about 190 to about 260 μm, from about 200 μm to about 250 μm or from about 210 μm to about 240 μm.

The thickness of the sheet or shredded sheet may vary between the first and second surfaces. In some embodiments, an individual strip or piece of the aerosolizable material has a minimum thickness over its area of about 100 μm. In some cases, an individual strip or piece of the aerosolizable material has a minimum thickness over its area of about 0.05 mm or about 0.1 mm. In some cases, an individual strip, strand or piece of the aerosolizable material has a maximum thickness over its area of about 1.0 mm. In some cases, an individual strip or piece of the aerosolizable material has a maximum thickness over its area of about 0.5 mm or about 0.3 mm.

The thickness of the sheet can be determined using ISO 534:2011 "Paper and Board-Determination of Thickness".

The inventors have established that, if the sheet or shredded sheet of aerosolizable material is too thick, then heating efficiency can be compromised. This can adversely affect power consumption in use, for instance the power consumption for release of flavor from the aerosolizable material. Conversely, if the aerosolizable material is too thin, it can be difficult to manufacture and handle; a very thin material can be harder to cast and may be fragile, compromising aerosol formation in use.

It is postulated that if the sheet or shredded sheet of aerosolizable material is too thin (e.g. less than 100 μm), then it may be necessary to increase the cut width of the shredded sheet to achieve sufficient packing of the aerosolizable material when it is incorporated into the article. As discussed previously, increasing the cut width of the shredded sheet can increase the pressure drop, which is undesirable.

It has postulated that a sheet or shredded sheet having a thickness of at least about 100 μm, along with an area density of from about 100 g/m$^2$ to about 250 g/m$^2$ is less liable to tear, split or become otherwise deformed during its manufacture. A thickness of at least about 100 μm may have a positive effect on the overall structural integrity and strength of sheet or shredded sheet. For example, it may have a good tensile strength and thus be relatively easy to process.

The thickness of the sheet or shredded sheet is also thought to have a bearing on its area density. That is to say, increasing the thickness of the sheet or shredded sheet may increase the area density of the sheet or shredded sheet.

Conversely, decreasing the thickness of the sheet or shredded sheet may decrease the area density of the sheet or shredded sheet. For the avoidance of doubt, where reference is made herein to area density, this refers to an average area density calculated for a given strip, strand, piece or sheet of the aerosolizable material, the area density calculated by measuring the surface area and weight of the given strip, strand, piece or sheet of aerosolizable material.

The sheet or shredded sheet of aerosol-generating material has an area density of from about 100 g/m$^2$ to about 250 g/m$^2$. The sheet or shredded sheet may have an area density of from about 110 g/m$^2$ to about 240 g/m$^2$, from about 120 g/m$^2$ to about 230 g/m$^2$, from about 130 g/m$^2$ to about 220 g/m$^2$ or from about 140 g/m$^2$ to about 210 g/m$^2$. In some embodiments, the sheet or shredded sheet has an area density of from about 130 g/m$^2$ to about 190 g/m$^2$, from about 140 g/m$^2$ to about 180 g/m$^2$, from about 150 g/m$^2$ to about 170 g/m$^2$. In some embodiments, the sheet or shredded sheet has an area density of about 160 g/m$^2$, 170 g/m$^2$, 180 g/m$^2$, 190 g/m$^2$ or 200 g/m$^2$. In a preferred embodiment, the sheet or shredded sheet has an area density of about 160 g/m$^2$.

The area density of about 100 g/m$^2$ to about 250 g/m$^2$ is thought to contribute to the strength and flexibility of sheet or shredded sheet. Furthermore, the inventors have found that a rod comprising a shredded sheet of aerosolizable material having an area density of around 180 gsm and a minimum thickness of 220-230 μm can be can be packed such that the aerosolizable material stays in place within the rod whilst maintaining a desired weight of tobacco material within the rod (e.g. around 300 mg) and delivering acceptable organoleptic properties (e.g. taste and smell) when heated in a non-combustible aerosol provision device.

In some embodiments, the aerosolizable material has an area density of 160 g/m$^2$ to 200 g/m$^2$ and a minimum thickness of 200 to 250 μm or an area density of 160 g/m$^2$ to 200 g/m$^2$ and a minimum thickness of 210 to 240 μm.

The flexibility of the sheet or shredded sheet is considered to be dependent, at least in part, upon the thickness and area density of the sheet or shredded sheet. A thicker sheet or shredded sheet may be less flexible than a thinner sheet or shredded sheet. Also, the greater the area density of the sheet, the less flexible the sheet or shredded sheet is. It is thought that the combined thickness and area density of the aerosolizable material described herein provides a sheet or shredded sheet that is relatively flexible. When the aerosolizable material is incorporated into an article for use in a non-combustible aerosol-provision device, this flexibility, may give rise to various advantages. For example, the strands or strips are able to readily deform and flex when an aerosol generator is inserted into the aerosol-generating material, thus facilitating insertion of an aerosol generator (e.g. a heater) into the material and also improving retention of the aerosol generator by the aerosolizable material.

Preferably, the strands or strips or aerosolizable material are not crimped, which further improves the ease by which the aerosol generator can be inserted into the aerosol-generating material. Without wishing to be bound by theory, this is thought to be because non-crimped strands or strips of aerosolizable material offer less resistance to the insertion of the aerosol generator.

The inventors have found that the area density of the sheet or shredded sheet of aerosol-generating material influences the roughness of the first and second surfaces of the sheet or shredded sheet. By changing the area density, the roughness of the first and/or second surfaces can be tailored.

The average volume density of the sheet or shredded sheet of aerosol-generating material may be calculated from the thickness of the sheet and the area density of the sheet. The average volume density may be greater than about 0.2 g/cm$^3$, about 0.3 g/cm$^3$ or about 0.4 g/cm$^3$. In some embodiments, the average volume density is from about 0.2 g/cm$^3$ to about 1 g/cm$^3$, from about 0.3 g/cm$^3$ to about 0.9 g/cm$^3$, from about 0.4 g/cm$^3$ to about 0.9 g/cm$^3$, from about 0.5 g/cm$^3$ to about 0.9 g/cm$^3$ or from about 0.6 g/cm$^3$ to about 0.9 g/cm$^3$.

According to an aspect of the disclosure, there is provided an aerosol-generating material comprising a sheet or shredded sheet of aerosolizable material comprising tobacco material, an aerosol-former material and a binder, wherein the sheet or shredded sheet has a density of greater than about 0.4 g/cm$^3$. In some embodiments, the density is from about 0.4 g/cm$^3$ to about 2.9 g/cm$^3$, from about 0.4 g/cm$^3$ to about 1 g/cm$^3$, from about 0.6 cm$^3$ to about 1.6 cm$^3$ or from about 1.6 cm$^3$ to about 2.9 cm$^3$.

The sheet or shredded sheet may have a tensile strength of at least 4 N/15 mm. In some embodiments, the sheet or shredded sheet has a tensile strength of up to about 30 N/15 mm, up to about 20 N/15 mm or up to about 15 N/15 mm.

The inventors have found that, where the sheet or shredded sheet has a tensile strength below 4 N/15 mm, the sheet or shredded sheet is likely to tear, break or otherwise deform during its manufacture and/or subsequent incorporation into an article for use in a non-combustible aerosol provision system. Tensile strength may be measured using ISO 1924: 2008.

The aerosol-generating material comprises tobacco material. The sheet or shredded sheet of aerosolizable material comprises tobacco material.

The tobacco material may be a particulate or granular material. In some embodiments, the tobacco material is a powder. Alternatively or in addition, the tobacco material may comprise may comprise strips, strands or fibers of tobacco. For example, the tobacco material may comprise particles, granules, fibers, strips and/or strands of tobacco. In some embodiments, the tobacco material consists of particles or granules of tobacco material.

The density of the tobacco material has an impact on the speed at which heat conducts through the material, with lower densities, for instance those below 900 mg/cc, conducting heat more slowly through the material, and therefore enabling a more sustained release of aerosol.

The tobacco material can comprise reconstituted tobacco material having a density of less than about 900 mg/cc, for instance paper reconstituted tobacco material. For instance, the aerosol-generating material comprises reconstituted tobacco material having a density of less than about 800 mg/cc. Alternatively or in addition, the aerosol-generating material can comprise reconstituted tobacco material having a density of at least 350 mg/cc.

The reconstituted tobacco material can be provided in the form of a shredded sheet. The sheet of reconstituted tobacco material may have any suitable thickness. The reconstituted tobacco material may have a thickness of at least about 0.145 mm, for instance at least about 0.15 mm, or at least about 0.16 mm. The reconstituted tobacco material may have a maximum thickness of about 0.30 mm or 0.25 mm, for instance the thickness of the reconstituted tobacco material may be less than about 0.22 mm, or less than about 0.2 mm. In some embodiments, the reconstituted tobacco material may have an average thickness in the range 0.175 mm to 0.195 mm.

In some embodiments, the tobacco is a particulate tobacco material. Each particle of the particulate tobacco material may have a maximum dimension. As used herein, the term "maximum dimension" refers to the longest straight line distance from any point on the surface of a particle of tobacco, or on a particle surface, to any other surface point on the same particle of tobacco, or particle surface. The maximum dimension of a particle of particulate tobacco material may be measured using scanning electron microscopy (SEM).

The maximum dimension of each particle of tobacco material can be up to about 200 μm. In some embodiments, the maximum dimension of each particle of tobacco material is up to about 150 μm.

A population of particles of the tobacco material may have a particle size distribution (D90) of at least about 100 μm. In some embodiments, a population of particles of the tobacco material has a particle size distribution (D90) of about 110 μm, at least about 120 μm, at least about 130 μm, at least about 140 μm or at least about μm. In an embodiment, a population of particles of the tobacco material has a particle size distribution (D90) of about 150 μm. Sieve analysis can also be used to determine the particle size distribution of the particles of tobacco material.

A particle size distribution (D90) of at least about 100 μm is thought to contribute to the tensile strength of the sheet or shredded sheet of aerosolizable material.

The inventors have found that a particle size distribution (D90) of less than 100 μm provides a sheet or shredded sheet of aerosolizable material having good tensile strength. However, the inclusion of such fine particles of tobacco material in the sheet or shredded sheet can increase its density. When the sheet or shredded sheet is incorporated into an article for use in a non-combustible aerosol provision system, this higher density may decrease the fill-value of the tobacco material. Advantageously, the inventors have found that a balance between a satisfactory tensile strength and suitable density (and thus fill-value) may be achieved where the particle size distribution (D90) is at least about 100 μm.

The particle size of the particulate tobacco material can also influence the roughness of the sheet or shredded sheet of aerosol-generating material. It is postulated that forming the sheet or shredded sheet of aerosol-generating material by incorporating relatively large particles of tobacco material decreases the density of the sheet or shredded sheet of aerosol-generating material.

The tobacco material may comprise tobacco obtained from any part of the tobacco plant. In some embodiments, the tobacco material comprises tobacco leaf.

The sheet or shredded sheet can comprise from 5% to about 90% by weight tobacco leaf.

The tobacco material may comprise lamina tobacco and/or tobacco stem, such as midrib stem. The lamina tobacco can be present in an amount of from 0% to about 100%, from about 20% to about 100%, from about 40% to about 100%, from about 40% to about 95%, from about 45% to about 90%, from about 50% to about 85% or from about 55% to about 80% by weight of the sheet or shredded sheet and/or tobacco material. In some embodiments, tobacco material consists or consists essentially of lamina tobacco material.

The tobacco material may comprise tobacco stem in an amount of from 0% to about 100%, from about 0% to about 50%, from about 0 to about 25%, from about 0 to about 20%, from about 5 to about 15% by weight of the sheet or shredded sheet.

In some embodiments, the tobacco material comprises a combination of lamina and tobacco stem. In some embodiments, the tobacco material can comprise lamina in an amount of from about 40% to about 95% and stem in an amount of from about 5% to about 60%, or lamina in an amount of from about 60% to about 95% and stem in an amount of from about 5% to about 40%, or lamina in an amount of from about 80% to about 95% and stem in an amount of from about 5% to about 20% by weight of the sheet or shredded sheet of aerosolizable material.

The inventors have found that the incorporation of stem may decrease the tackiness of the aerosolizable material. The inventors have also surprisingly found that incorporating tobacco material comprising stem tobacco into the aerosolizable material may increase its burst strength.

The sheet or the shredded sheet of aerosolizable material may have a burst strength of at least about 75 g, at least about 100 g or at least about 200 g.

If the burst strength is too low the sheet or shredded sheet may be relatively brittle. As a consequence, breakages in the sheet or shredded sheet may occur during the process of manufacturing the aerosolizable material. For example, when the sheet is shredded to form a shredded sheet by a cutting process, the sheet may shatter or break into pieces or shards when cut.

The tobacco material described herein contains nicotine. The nicotine content is from 0.1 to 3% by weight of the tobacco material, and may be, for example, from 0.5 to 2.5% by weight of the tobacco material. Additionally or alternatively, the tobacco material contains between 10% and 90% by weight tobacco leaf having a nicotine content of greater than about 1% or about 1.5% by weight of the tobacco leaf. The tobacco leaf, for instance cut rag tobacco, can, for instance, have a nicotine content of between 1% and 5% by weight of the tobacco leaf.

The sheet or shredded sheet of aerosolizable material may comprise nicotine in an amount of between about 0.1% to about 3% by weight of the sheet or shredded sheet.

Paper reconstituted tobacco may also be present in the aerosol-generating material described herein. Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper reconstituted tobacco may be any type of paper reconstituted tobacco that is known in the art. In a particular embodiment, the paper reconstituted tobacco is made from a feedstock comprising one or more of tobacco strips, tobacco stems, and whole leaf tobacco. In a further embodiment, the paper reconstituted tobacco is made from a feedstock consisting of tobacco strips and/or whole leaf tobacco, and tobacco stems. However, in other embodiments, scraps, fines and winnowings can alternatively or additionally be employed in the feedstock.

The paper reconstituted tobacco for use in the tobacco material described herein may be prepared by methods which are known to those skilled in the art for preparing paper reconstituted tobacco.

In embodiments, the paper reconstituted tobacco is present in an amount of from 5% to 90% by weight, 10% to 80% by weight, or 20% to 70% by weight, of the aerosol-generating material.

The aerosol-generating material comprises an aerosol-former material. The aerosol-former material comprises one or more constituents capable of forming an aerosol. The aerosol-former material comprises one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. Preferably, the aerosol-former material is glycerol or propylene glycol.

The sheet or shredded sheet of aerosolizable material comprises an aerosol-former material. The aerosol-former material is provided in an amount of up to about 50% on a dry weight base by weight of the sheet or shredded sheet. In some embodiments, the aerosol former material is provided in an amount of from about 5% to about 40% on a dry weight base by weight of the sheet or shredded sheet, from about 10% to about 30% on a dry weight base by weight of the sheet or shredded sheet or from about 10% to about 20% on a dry weight base by weight of the sheet or shredded sheet.

The sheet or shredded sheet may also comprise water. The sheet or shredded sheet of aerosolizable material may comprise water in an amount of less than about 15%, less than about 10% or less than about 5% by weight of the aerosolizable material. In some embodiments, the aerosolizable material comprises water in an amount of between about 0% and about 15% or between about 5% and about 15% by weight of the aerosolizable material.

The sheet or shredded sheet of aerosolizable material may comprise water and an aerosol-former material, in a total amount, of less than about 30% by weight of the sheet or shredded sheet of aerosolizable material or less than about 25% by weight of the sheet or shredded sheet of aerosolizable material. It is thought that incorporating water and aerosol-former material in the sheet or shredded sheet of aerosolizable material in an amount of less than about 30% by weight of the sheet or shredded sheet of aerosolizable material may advantageously reduce the tackiness of the sheet. This may improve the ease by which the aerosolizable material can be handled during processing. For example, it may be easier to roll a sheet of aerosolizable material to form a bobbin of material and then unroll the bobbin without the layers of sheet sticking together. Reducing the tackiness may also decrease the propensity for strands or strips of shredded material to clump or stick together, thus further improving processing efficiency and the quality of the final product.

The sheet or shredded sheet comprises a binder. The binder is arranged to bind the components of the aerosol-generating material to form the sheet or shredded sheet. The binder may at least partially coat the surface of the tobacco material. Where the tobacco material is in a particulate form, the binder may at least partially coat the surface of the particles of tobacco and bind them together.

The binder may be selected from one or more compounds selected from the group comprising alginates, pectins, starches (and derivatives), celluloses (and derivatives), gums, silica or silicones compounds, clays, polyvinyl alcohol and combinations thereof. For example, in some embodiments, the binder comprises one or more of alginates, pectins, hydroxyethyl cellulose, hydroxypropyl cellulose, carboxymethylcellulose, pullulan, xanthan gum, guar gum, carrageenan, agarose, acacia gum, fumed silica, PDMS, sodium silicate, kaolin and polyvinyl alcohol. In some cases, the binder comprises alginate and/or pectin or carrageenan. In a preferred embodiment, the binder comprises guar gum.

The binder may be present in an amount of from about 1 to about 20% by weight of the sheet or shredded sheet, or in an amount of from 1 to about 10% by weight of the sheet or shredded sheet of aerosolizable material. For example, the binder may be present in an amount of about 1%, 2%, 3%, 4%, 5%, 6%, 7%, 8%, 9% or 10% by weight of the sheet or shredded sheet of aerosolizable material.

The aerosol-generating material may comprise a filler. In some embodiments, the sheet or shredded sheet comprises the filler. The filler is generally a non-tobacco component, that is, a component that does not include ingredients originating from tobacco. The filler may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may be a non-tobacco fiber such as wood fiber or pulp or wheat fiber. The filler can be a material comprising cellulose or a material comprises a derivate of cellulose. The filler component may also be a non-tobacco cast material or a non-tobacco extruded material.

In particular embodiments which include filler, the filler is fibrous. For example, the filler may be a fibrous organic filler material such as wood, wood pulp, hemp fiber, cellulose or cellulose derivatives. Without wishing to be bound by theory, it is believed that including fibrous filler may increase the tensile strength of the material.

The filler may also contribute to the texture of the sheet or shredded sheet of the aerosolizable material. For example, a fibrous filler, such as wood or wood pulp, may provide a sheet or shredded sheet of aerosolizable material having relatively rough first and second surfaces. Conversely, a non-fibrous, particulate filler, such as powdered chalk, may provide a sheet or shredded sheet of aerosolizable material having relatively smooth first and second surfaces. In some embodiments, the aerosolizable material comprises a combination of different filler materials.

The filler component may be present in an amount of 0 to 20% by weight of the sheet or shredded sheet, or in an amount of from 1 to 10% by weight of the sheet or shredded sheet. In some embodiments, the filler component is absent.

The filler may help to improve the general structural properties of the aerosolizable material, such as its tensile strength and burst strength.

In the compositions described herein, where amounts are given in % by weight, for the avoidance of doubt this refers to a dry weight basis, unless specifically indicated to the contrary. Thus, any water that may be present in the aerosol-generating material, or in any component thereof, is entirely disregarded for the purposes of the determination of the weight %. The water content of the aerosol-generating material described herein may vary and may be, for example, from 5 to 15% by weight. The water content of the aerosol-generating material described herein may vary according to, for example, the temperature, pressure and humidity conditions at which the compositions are maintained. The water content can be determined by Karl-Fisher analysis, as known to those skilled in the art. On the other hand, for the avoidance of doubt, even when the aerosol-former material is a component that is in liquid phase, such as glycerol or propylene glycol, any component other than water is included in the weight of the aerosol-generating material. However, when the aerosol-former material is provided in the tobacco component of the aerosol-generating material, or in the filler component (if present) of the aerosol-generating material, instead of or in addition to being added separately to the aerosol-generating material, the aerosol-former material is not included in the weight of the tobacco component or filler component, but is included in the weight of the "aerosol-former material" in the weight % as defined herein. All other ingredients present in the tobacco component are included in the weight of the tobacco component, even if of non-tobacco origin (for example non-tobacco fibers in the case of paper reconstituted tobacco).

The aerosol-generating material herein can comprise an aerosol modifying agent, such as any of the flavors described herein. In one embodiment, the aerosol-generating material comprises menthol. When the aerosol-generating material is incorporated into an article for use in an aerosol-provision system, the article may be referred to as a mentholated article. The aerosol-generating material can comprise from 0.5 mg to 20 mg of menthol, from 0.7 mg to 20 mg of menthol, between 1 mg and 18 mg or between 8 mg and 16 mg of menthol. In the present example, the aerosol-generating material comprises 16 mg of menthol. The aerosol-generating material can comprise between 1% and 8% by weight of menthol, preferably between 3% and 7% by weight of menthol and more preferably between 4% and 5.5% by weight of menthol. In one embodiment, the aerosol-generating material comprises 4.7% by weight of menthol. Such high levels of menthol loading can be achieved using a high percentage of reconstituted tobacco material, for instance greater than 50% of the tobacco material by weight. Alternatively or additionally, the use of a high volume of, for instance tobacco material, can increase the level of menthol loading that can be achieved, for instance where greater than about 500 $mm^3$ or suitably more than about 1000 $mm^3$ of aerosol-generating material, such as tobacco material, are used.

In some embodiments, the composition comprises an aerosol-forming "amorphous solid", which may alternatively be referred to as a "monolithic solid" (i.e. non-fibrous) . In some embodiments, the amorphous solid may comprise a dried gel. The amorphous solid is a solid material that may retain some fluid, such as liquid, within it.

In some examples, the amorphous solid comprises:

1-60 wt % of a gelling agent;

0.1-50 wt % of an aerosol-former material; and 0.1-80 wt % of a flavor;

wherein these weights are calculated on a dry weight basis.

In some further embodiments, the amorphous solid comprises:

1-50 wt % of a gelling agent;

0.1-50 wt % of an aerosol-former material; and 30-60 wt % of a flavor;

wherein these weights are calculated on a dry weight basis.

The amorphous solid material may be provided in sheet or in shredded sheet form. The amorphous solid material may take the same form as the sheet or shredded sheet, as described previously in relation to the aerosolizable material.

Suitably, the amorphous solid may comprise from about 1 wt %, 5 wt %, 10 wt %, 15 wt %, 20 wt % or 25 wt % to about 60 wt %, 50 wt %, 45 wt %, 40 wt % or 35 wt % of a gelling agent (all calculated on a dry weight basis). For example, the amorphous solid may comprise 1-50 wt %, 5-45 wt %, 10-40 wt % or 20-35 wt % of a gelling agent. In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In some embodiments, the gelling agent comprises alginate, and the alginate is present in the amorphous solid in an amount of from 10-30 wt % of the amorphous solid (calculated on a dry weight basis). In some embodiments, alginate is the only gelling agent present in the amorphous solid. In other embodiments, the gelling agent comprises alginate and at least one further gelling agent, such as pectin.

In some embodiments the amorphous solid may include gelling agent comprising carrageenan.

Suitably, the amorphous solid may comprise from about 0.1 wt %, 0.5 wt %, 1*wt*%, 3 wt %, 5 wt %, 7 wt % or 10% to about 50 wt %, 45 wt %, 40 wt %, 35 wt %, 30 wt % or 25 wt % of an aerosol-former material (all calculated on a dry weight basis). The aerosol-former material may act as a plasticizer. For example, the amorphous solid may comprise 0.5-40 wt %, 3-35 wt % or 10-25 wt % of an aerosol-former material. In some cases, the aerosol-former material comprises one or more compound selected from erythritol, propylene glycol, glycerol, triacetin, sorbitol and xylitol. In some cases, the aerosol-former material comprises, consists essentially of or consists of glycerol.

The amorphous solid comprises a flavor. Suitably, the amorphous solid may comprise up to about 80 wt %, 70 wt %, 60 wt %, 55 wt %, 50 wt % or 45 wt % of a flavor.

In some cases, the amorphous solid may comprise at least about 0.1 wt %, 1wt%, 10 wt %, 20 wt %, 30 wt %, 35 wt % or 40 wt % of a flavor (all calculated on a dry weight basis).

For example, the amorphous solid may comprise 1-80 wt %, 10-80 wt %, 20-70 wt %, 30-60 wt %, 35-55 wt % or 30-45 wt % of a flavor. In some cases, the flavor comprises, consists essentially of or consists of menthol.

In some cases, the amorphous solid may additionally comprise an emulsifying agent, which emulsified molten flavor during manufacture. For example, the amorphous solid may comprise from about 5 wt % to about 15 wt % of an emulsifying agent (calculated on a dry weight basis), suitably about 10 wt %. The emulsifying agent may comprise acacia gum.

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis. In some cases, the hydrogel may comprise at least about 1 wt %, 2 wt % or at least about 5 wt % of water (WWB).

In some embodiments, the amorphous solid additionally comprises an active substance. For example, in some cases, the amorphous solid additionally comprises a tobacco material and/or nicotine. In some cases, the amorphous solid may comprise 5-60 wt % (calculated on a dry weight basis) of a tobacco material and/or nicotine. In some cases, the amorphous solid may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of an active substance. In some cases, the amorphous solid may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of a tobacco material. For example, the amorphous solid may comprise 10-50 wt %, 15-40 wt % or 20-35 wt % of a tobacco material. In some cases, the amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid may comprise 1-20 wt %, 2-18 wt % or 3-12 wt % of nicotine.

In some cases, the amorphous solid comprises an active substance such as tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 60 wt %, 50 wt %, 45 wt %, 40 wt %, 35 wt %, or 30 wt % (calculated on a dry weight basis) tobacco extract. For example, the amorphous solid may comprise 10-50 wt %, 15-40 wt % or 20-35 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine.

In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid may comprise 1-20 wt %, 2-18 wt % or 3-12 wt % of nicotine.

In some cases, the total content of active substance and/or flavor may be at least about 0.1 wt %, 1 wt %, 5 wt %, 10 wt %, 20 wt %, 25 wt % or 30 wt %. In some cases, the total content of active substance and/or flavor may be less than about 90 wt %, 80 wt %, 70 wt %, 60 wt %, 50 wt % or 40 wt % (all calculated on a dry weight basis).

In some cases, the total content of tobacco material, nicotine and flavor may be at least about 0.1 wt %, 1 wt %, 5 wt %, 10 wt %, 20 wt %, 25 wt % or 30 wt %. In some cases, the total content of active substance and/or flavor may be less than about 90 wt %, 80 wt %, 70 wt %, 60 wt %, 50 wt % or 40 wt % (all calculated on a dry weight basis).

The amorphous solid may be made from a gel, and this gel may additionally comprise a solvent, included at 0.1-50 wt %. However, the inventors have established that the inclusion of a solvent in which the flavor is soluble may reduce the gel stability and the flavor may crystallize out of the gel. As such, in some cases, the gel does not include a solvent in which the flavor is soluble.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In particular cases, the amorphous solid comprises no calcium carbonate such as chalk.

In particular embodiments which include filler, the filler is fibrous. For example, the filler may be a fibrous organic filler material such as wood pulp, hemp fiber, cellulose or cellulose derivatives. Without wishing to be bound by theory, it is believed that including fibrous filler in an amorphous solid may increase the tensile strength of the material.

In some embodiments, the amorphous solid does not comprise tobacco fibers.

In some examples, the amorphous solid in sheet form may have a tensile strength of from around 200 N/m to around 1500 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the amorphous solid material is formed as a sheet and then shredded and incorporated into an aerosol-generating article.

In some examples, such as where the amorphous solid comprises a filler, the amorphous solid may have a tensile strength of from 600 N/m to 1500 N/m, or from 700 N/m to 900 N/m, or around 800 N/m. Such tensile strengths may be particularly suitable for embodiments wherein the amorphous solid material is included in an aerosol-generating article as a rolled sheet, suitably in the form of a tube.

In some cases, the amorphous solid may consist essentially of, or consist of a gelling agent, water, an aerosol-former material, a flavor, and optionally an active substance.

In some cases, the amorphous solid may consist essentially of, or consist of a gelling agent, water, an aerosol-former material, a flavor, and optionally a tobacco material and/or a nicotine source.

The amorphous solid may comprise one or more active substances and/or flavors, one or more aerosol-former materials, and optionally one or more other functional material.

The aerosol-generating material can comprise a paper reconstituted tobacco material. The composition can alternatively or additionally comprise any of the forms of tobacco described herein. The aerosol-generating material can comprise a sheet or shredded sheet comprising tobacco material comprising between 10% and 90% by weight tobacco leaf, wherein an aerosol-former material is provided in an amount of up to about 20% by weight of the sheet or shredded sheet, and the remainder of the tobacco material comprises paper reconstituted tobacco.

Where the aerosol-generating material comprises an amorphous solid material, the amorphous solid material may be a dried gel comprising menthol. In alternative embodiments, the amorphous solid may have any composition as described herein.

The inventors have advantageously found that an improved article may be produced comprising aerosol-generating material comprising a first component comprising a sheet or shredded sheet of aerosolizable material and a second component comprising amorphous solid, wherein the material properties (e.g. density) and specification (e.g. thickness, length, and cut width) fall within the ranges set out herein.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of about 0.09 mm can be used. The amorphous solid may comprise more than one layer, and the thickness described herein refers to the aggregate thickness of those layers.

The thickness of the amorphous solid material may be measured using a caliper or a microscope such as a scanning electron microscope (SEM), as known to those skilled in the art, or any other suitable technique known to those skilled in the art.

The inventors have established that if the amorphous solid is too thick, then heating efficiency can be compromised. This can adversely affect power consumption in use, for instance the power consumption for release of flavor from the amorphous solid. Conversely, if the aerosol-forming amorphous solid is too thin, it can be difficult to manufacture and handle; a very thin material can be harder to cast and may be fragile, compromising aerosol formation in use. In some cases, an individual strip or piece of the amorphous solid has a minimum thickness over its area of about 0.015. In some cases, an individual strip or piece of the amorphous solid has a minimum thickness over its area of about 0.05 mm or about 0.1 mm. In some cases, an individual strip or piece of the amorphous solid has a maximum thickness over its area of about 1.0 mm. In some cases, an individual strip or piece of the amorphous solid has a maximum thickness over its area of about 0.5 mm or about 0.3 mm.

In some cases, the amorphous solid thickness may vary by no more than 25%, 20%, 15%, 10%, 5% or 1% across its area.

The inventors have found that providing amorphous solid material and sheet or shredded sheet of aerosolizable material having area density values that differ from each other by less than a given percentage results in less separation in a mixture of these materials. In some examples, the area density of the amorphous solid material may be between 50% and 150% of the area density of the aerosolizable material. For instance, the area density of the amorphous solid material may be between 60% and 140% of the density of the aerosolizable material, or between 70% and 110% of the area density of the aerosolizable material, or between 80% and 120% of the area density of the aerosolizable material.

In embodiments described herein, the amorphous solid material may be incorporated into the article in sheet form. The amorphous solid material in sheet form may be shredded and then incorporated into the article, suitably mixed into with an aerosolizable material, such as the sheet or shredded sheet of aerosolizable material described herein.

In further embodiments the amorphous solid sheet may additionally be incorporated as a planar sheet, as a gathered or bunched sheet, as a crimped sheet, or as a rolled sheet (i.e. in the form of a tube). In some such cases, the amorphous solid of these embodiments may be included in an aerosol-generating article as a sheet, such as a sheet circumscribing a rod comprising aerosolizable material. For example, the amorphous solid sheet may be formed on a wrapping paper which circumscribes an aerosolizable material such as tobacco.

The amorphous solid in sheet form may have any suitable area density, such as from about 30 $g/m^2$ to about 150 $g/m^2$. In some cases, the sheet may have a mass per unit area of about 55 $g/m^2$ to about 135 $g/m^2$, or about 80 to about 120 $g/m^2$, or from about 70 to about 110 $g/m^2$, or particularly from about 90 to about 110 $g/m^2$, or suitably about 100 $g/m^2$. These ranges can provide a density which is similar to the density of cut rag tobacco and as a result a mixture of these substances can be provided which will not readily separate. Such area densities may be particularly suitable where the amorphous solid material is included in an aerosol-generating article as a shredded sheet (described further herein). In some cases, the sheet may have a mass per unit area of about 30 to 70 $g/m^2$, 40 to 60 $g/m^2$, or 25 to 60 $g/m^2$ and may be used to wrap an aerosolizable material, such as the aerosolizable material described herein.

The aerosol-generating material may comprise a blend of the aerosolizable material and the amorphous solid material as described herein. Such aerosol-generating material can provide an aerosol, in use, with a desirable flavor profile, since additional flavor may be introduced to the aerosol-generating material by inclusion in the amorphous solid material component. Flavor provided in the amorphous solid material may be more stably retained within the amorphous solid material compared to flavor added directly to the tobacco material, resulting in a more consistent flavor profile between articles produced according to this disclosure.

As described above, tobacco material having a density of at least 350 mg/cc and less than about 900 mg/cc, preferably between about 600 mg/cc and about 900 mg/cc, has been advantageously found to result in a more sustained release of aerosol. To provide an aerosol having a consistent flavor profile the amorphous solid material component of the aerosol-generating material should be evenly distributed throughout the rod. The inventors have advantageously found that this can be achieved by casting the amorphous solid material to have a thickness as described herein, to provide an amorphous solid material having an area density which is similar to the area density of the tobacco material, and processing the amorphous solid material as described herein to ensure an even distribution throughout the aerosol-generating material.

According to an aspect of the disclosure, there is provided a process for manufacturing an aerosol-generating material as described herein.

The process comprises combining tobacco material, an aerosol-former material, water and a binder to form a slurry. The slurry is then processed to form a sheet of aerosolizable material comprising the tobacco material, the aerosol-former material and the binder. The slurry may be processed by forming a layer of the slurry on a surface and then drying the slurry to remove at least some of the water and form the sheet of the aerosolizable material.

The water may be removed by allowing the water to evaporate from the slurry at ambient temperature and pressure (e.g. 25° C. and 101 kPa.) Alternatively, the water may be removed by applying heat to the slurry (e.g. by heating it to about 25° C.) and/or reducing the atmospheric pressure surrounding the slurry (e.g. to less than 101 kPa).

In some embodiments, the slurry is processed by band casting it.

After drying, the sheet of aerosolizable material can be cut into strips or strands of aerosolizable material. The strips or strands of aerosolizable material can be gathered and formed into an article for use in a non-combustible aerosol provision system. A suitable process for cutting the sheet of aerosolizable material and gathering it into the article is found in WO 2019/057796. Optionally, the aerosolizable material can be crimped prior to being gathered and formed into the article.

FIG. 1 illustrates how an article for use in a non-combustible aerosol-provision system comprising the aerosol-generating material may be manufactured. At step S101, a slurry comprising tobacco material, an aerosol-former material, water and binder is formed. Optionally, a fibrous material is added at this point (e.g. wood pulp/wood fibers). At step S102, a layer of the slurry is formed on a surface. At step S103, the layer of slurry is dried on the surface to form a sheet or aerosolizable material. At step S104 a single thickness of the sheet of aerosolizable material is fed into a shredding apparatus. This can be achieved, for example, by providing a bobbin of sheet material which can be continuously fed into a shredding apparatus. Alternatively, a discrete portion of the aerosolizable material in sheet form, such as a sheet known to those skilled in the art as a flag, can be fed into a shredding apparatus.

The inventors have surprisingly found that, in contrast to the conventional tobacco cutting process where several sheets of lamina material are fed to a cutting apparatus simultaneously, there are benefits for aerosol-generating material in sheet form when shredded in single sheet thicknesses. Feeding multiple thicknesses of aerosol-generating material into a shredding apparatus in a single pass tends to result in uneven distribution of the material in the final aerosol-generating material, as multiple thicknesses of the sheet material adhere together, resulting in the formation of clumps.

At step S105, the sheet of aerosolizable material is shredded to form strands or strips of aerosolizable material. Optionally the aerosolizable material may be subject to a second cutting step (not shown), such as in a cross-cut type shredding process, to obtain a defined cut length.

At step S106, the strands or strips of aerosolizable material are gathered together to form an aerosol-generating section of an article.

By altering the thickness of the initial slurry layer in step S102 and the quantity of tobacco material, aerosol former and binder in the material, the thickness and volume and area densities of the sheet or shredded sheet of aerosolizable material can be tailored.

According to an aspect of the present disclosure, there is provided an article for use in a non-combustible aerosol provision system. The article comprises an aerosol-generating material, as described herein.

In the figures described herein, like reference numerals are used to illustrate equivalent features, articles or components.

Figure 2:
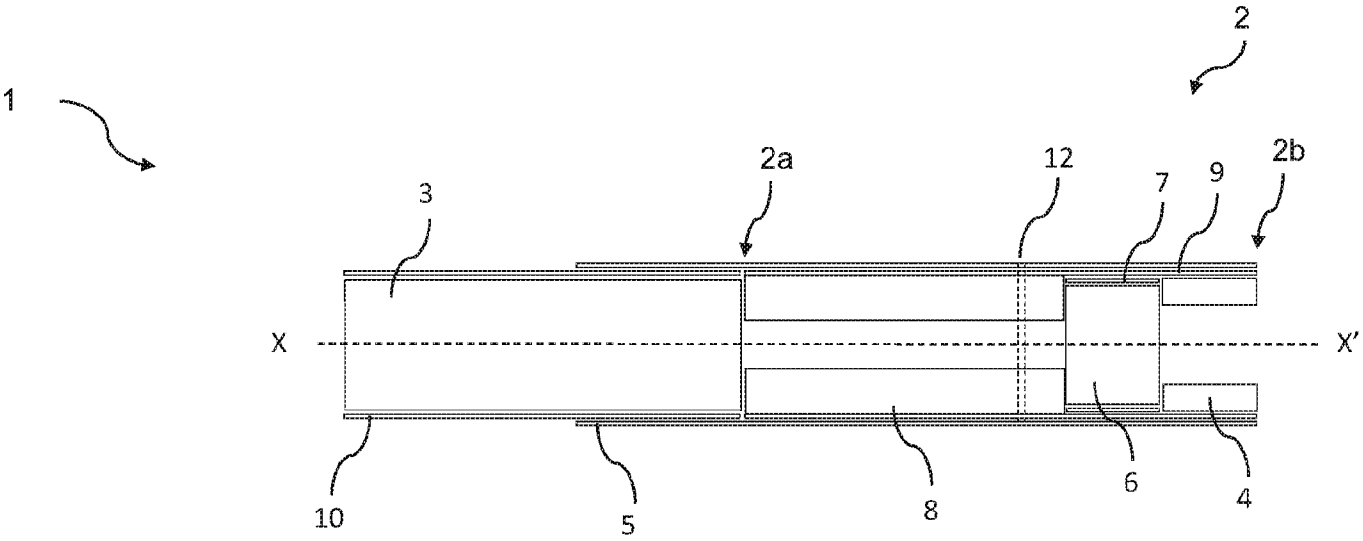
FIG. 2 is a side-on cross sectional view of an article for use with a non-combustible aerosol provision device, the article including a mouthpiece.

FIG. 2 is a side-on cross sectional view of an article 1 for use in an aerosol delivery system.

The article 1 comprises a mouthpiece 2, and an aerosol-generating section, connected to the mouthpiece 2. In the present example, the aerosol-generating section comprises a source of aerosol-generating material in the form of a cylindrical rod of aerosol-generating material 3. In other examples, the aerosol-generating section may comprise a cavity for receiving a source of aerosol-generating material.

The aerosol-generating material comprises a plurality of strands or strips of aerosol-generating material as described herein. For example, the aerosol-generating material may comprise a plurality of strands or strips of an aerosolizable material and optionally a plurality of strands or strips of an amorphous solid, as described herein. In some embodiments, the aerosol-generating material consists of a plurality of strands or strips of the aerosolizable material.

In the present example, the cylindrical rod of aerosol-generating material 3 comprises a plurality of strands and/or strips of aerosol-generating material, and is circumscribed by a wrapper 10. The wrapper 10 can be a moisture impermeable wrapper.

In the present example, the rod of aerosol-generating material 3 has a circumference of about 22.7 mm. In alternative embodiments, the rod of aerosol-generating material 3 may have any suitable circumference, for example between about 20 mm and about 26 mm.

The article 1 is configured for use in a non-combustible aerosol provision device comprising an aerosol generator for insertion into the aerosol-generating section. In the present example, the aerosol generator is a heater, and the article is configured to receive the aerosol generator in the rod of aerosol-generating material.

The wrapper 10 which circumscribes the rod of aerosol-generating material may comprise a cellulose based material having a basis weight greater than about 40 grams per square meter (gsm), for example, greater than about 30 gsm, preferably greater than about 40 gsm, more preferably greater than about 50 gsm. The inventors have advantageously found such basis weights provide an improved rigidity to the rod of aerosol-generating material. In the present example, the wrapper 10 comprises a paper wrapper.

The improved rigidity provided by wrappers having a basis weight greater than about 30 gsm, greater than about 40 gsm, or greater than about 50 gsm, can make the rod of aerosol-generating material 3 more resistant to crumpling or other deformation under the forces to which the article is subject, in use, for example when the article is inserted into a device and/or a heat generator is inserted into the article. Providing a rod of aerosol-generating material having increased rigidity can be beneficial where the plurality of strands or strips of aerosol-generating material 3 are aligned within the aerosol-generating section such that their longitudinal dimension is in parallel alignment with the longitudinal axis, since longitudinally aligned strands or strips of aerosol-generating material may provide less rigidity to the rod of aerosol-generating material than when the strands or strips are not aligned. The improved rigidity of the rod of aerosol-generating material allows the article to withstand the increased forces to which the article is subject, in use.

In other embodiments, the wrapper 10 optionally comprises a barrier coating to make the material of the wrapper substantially moisture impermeable. For example, a layer of aluminum foil provided on the wrapper 10 has been found to be particularly effective at enhancing the formation of aerosol within the aerosol-generating material 3. For example, a layer of aluminum foil having a thickness of between about between 4 μm and 16 μm, for example about 6 μm can be provided on the wrapper. Metallic layers or foils other than aluminum can also be used. The total thickness of the wrapper is preferably between 20 μm and 90 μm, more preferably between 30 μm and 60 μm, which can provide a wrapper having appropriate structural integrity and heat transfer characteristics. The tensile force which can be applied to the wrapper before it breaks can be greater than 3,000 grams force, for instance between 3,000 and 10,000 grams force or between 3,000 and 4,500 grams force.

In the present example, the wrapper 10 is also substantially impermeable to air. In alternative embodiments, the wrapper 10 preferably has a permeability of less than 100 Coresta Units, more preferably less than 60 Coresta Units. It has been found that low permeability wrappers, for instance having a permeability of less than 100 Coresta Units, more preferably less than 60 Coresta Units, result in an improvement in the aerosol formation in the aerosol-generating material 3. Without wishing to be bound by theory, it is hypothesized that this is due to reduced loss of aerosol compounds through the wrapper 10. The permeability of the wrapper 10 can be measured in accordance with ISO 2965: 2009 concerning the determination of air permeability for materials used as cigarette papers, filter plug wrap and filter joining paper.

A tipping paper 5 is wrapped around the full length of the mouthpiece 2 and over part of the rod of aerosol-generating material 3 and has an adhesive on its inner surface to connect the mouthpiece 2 and rod 3. In the present example, the tipping paper 5 extends 5 mm over the rod of aerosol-generating material 3 but it can alternatively extend between 3 mm and 10 mm over the rod 3, or more preferably between 4 mm and 6 mm, to provide a secure attachment between the mouthpiece 2 and rod 3. The tipping paper can have a basis weight greater than 20 gsm, for instance greater than 25 gsm, or preferably greater than 30 gsm, for example 37 gsm. These ranges of basis weights have been found to result in tipping papers having acceptable tensile strength while being flexible enough to wrap around the article 1 and adhere to itself along a longitudinal lap seam on the paper. In the present example, the outer circumference of the tipping paper 5, once wrapped around the mouthpiece 2, is about 23 mm.

The mouthpiece 2 includes a cooling section 8, also referred to as a cooling element, positioned immediately downstream of and adjacent to the source of aerosol-generating material 3. In the present example, the cooling section 8 is in an abutting relationship with the source of aerosol-generating material. The mouthpiece 2 also includes, in the present example, a body of material 6 downstream of the cooling section 8, and a hollow tubular element 4 downstream of the body of material 6, at the mouth end of the article 1.

The cooling section 8 comprises a hollow channel, having an internal diameter of between about 1 mm and about 4 mm, for example between about 2 mm and about 4 mm. In the present example, the hollow channel has an internal diameter of about 3 mm. The hollow channel extends along the full length of the cooling section 8. In the present example, the cooling section 8 comprises a single hollow channel. In alternative embodiments, the cooling section can comprise multiple channels, for example, 2, 3 or 4 channels. In the present example, the single hollow channel is substantially cylindrical, although in alternative embodiments, other channel geometries/cross-sections may be used. The hollow channel can provide a space into which aerosol drawn into the cooling section 8 can expand and cool down. In all embodiments, the cooling section is configured to limit the cross-sectional area of the hollow channel/s, to limit tobacco displacement into the cooling section, in use.

The moisture impermeable wrapper 10 can have a lower friction with the aerosol-generating material, which can result in strands and/or strips of aerosol-generating material being more easily displaced longitudinally, into the cooling section, when the aerosol generator is inserted into the rod of aerosol-generating material. The inventors have found that providing a cooling section 8 directly adjacent to the source of aerosol-generating material, and comprising an inner channel with a diameter in this range, advantageously reduces the longitudinal displacement of strands and/or strips of aerosol-generating material when the aerosol generator is inserted into the rod of aerosol-generating material. The inventors have found that reducing the displacement of aerosol-generating material, in use, can advantageously result in a more consistent packing density of aerosol-generating material along the length of the rod and/or within a cavity, which can result in more consistent and readily controllable aerosol generation.

When the aerosol generator is inserted into the rod of aerosol-generating material 3, strands and or strips of aerosol-generating material can be displaced longitudinally, into the cooling section. The inventors have found that providing a cooling section 8 directly adjacent to the source of aerosol-generating material, and comprising an inner channel with a diameter in this range, advantageously reduces the longitudinal displacement of strands and/or strips of aerosol-generating material when the aerosol generator is inserted into the rod of aerosol-generating material. The inventors have found that reducing the displacement of aerosol-generating material, in use, can advantageously result in a more consistent packing density of aerosol-generating material along the length of the rod and/or within a cavity, which can result in more consistent and improved aerosol generation.

The rod of aerosol-generating material 3 and the cooling section 8 each have a cross-sectional area, measured perpendicular to the longitudinal axis of the article 1, indicated by the line X-X' in FIG. 2. The cooling section is configured so that a maximum percentage of the cross sectional area of the cooling section consists of hollow inner channel, for example less than about 45% of the cross sectional area, preferably less than 30% of the cross sectional area, more preferably less than 25% of the cross sectional area. In the present example, about 18% of the cross sectional area of the cooling section consists of the hollow channel.

Additionally or alternatively, at least about 4% of the cross sectional area of the cooling section can be occupied by the hollow inner channel, or at least about 6%, or at least about 8%. In some examples, between 4% and 32% of the cross sectional area of the cooling section is occupied by the hollow inner channel.

The cooling section 8 preferably has a wall thickness in a radial direction, which can be measured, for example, using a caliper. The wall thickness of the cooling section 8, for a given outer diameter of cooling section, defines the internal diameter for the cavity surrounded by the walls of the cooling section 8. The cooling section 8 preferably has a wall thickness of at least about 1.5 mm and up to about 2 mm. In the present example, the cooling section 8 has a wall thickness of about 1.5 mm. The inventors have advantageously found that providing a cooling section 8 having a wall thickness within this range improves the retention of the source of aerosol-generating material in the aerosol-generating section, in use, by reducing the longitudinal displacement of strands and/or strips of aerosol-generating material when the aerosol generator is inserted into the article.

The cooling section 8 is formed from filamentary tow. Other constructions can be used, such as a plurality of layers of paper which are parallel wound, with butted seams, to form the tubular element 8; or as spirally wound layers of paper, cardboard tubes, tubes formed using a papier-mâché type process, molded or extruded plastic tubes or similar. The cooling section 8 is manufactured to have a rigidity that is sufficient to withstand the axial compressive forces and bending moments that might arise during manufacture and whilst the article 1 is in use.

The filamentary tow material described herein can comprise cellulose acetate fiber tow. The filamentary tow can also be formed using other materials used to form fibers, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, cotton, aliphatic polyester materials and polysaccharide polymers or a combination thereof. The filamentary tow may be plasticized with a suitable plasticizer for the tow, such as triacetin where the material is cellulose acetate tow, or the tow may be non-plasticized. The tow can have any suitable specification, such as fibers having a 'Y' shaped or other cross section such as 'X' shaped, filamentary denier values between 2.5 and 15 denier per filament, for example between 8.0 and 11.0 denier per filament and total denier values of 5,000 to 50,000, for example between 10,000 and 40,000.

The filamentary tow forming the cooling section 8 preferably has a denier per filament of greater than 3. This denier per filament has been found to allow the formation of a tubular element 4 which is not too dense. Preferably, the denier per filament is at least 4, more preferably at least 5. In preferred embodiments, the filamentary tow forming the hollow tubular element 4 has a denier per filament between 4 and 10, more preferably between 4 and 9. In one example, the filamentary tow forming the cooling section 8 has an 8Y40,000 tow formed from cellulose acetate and comprising 18% plasticizer, for instance triacetin.

The wall material of the cooling section 8 can be relatively non-porous, such that at least 90% of the aerosol generated by the aerosol-generating material 3 passes longitudinally through the one or more hollow channels rather than through the wall material of the cooling section 8. For instance, at least 92% or at least 95% of the aerosol generated by the aerosol-generating material 3 can pass longitudinally through the one or more hollow channels.

Preferably, the length of the cooling section 8 is less than about 30 mm. More preferably, the length of the cooling section 8 is less than about 25 mm. Still more preferably, the length of the cooling section 8 is less than about 20 mm. In addition, or as an alternative, the length of the cooling section 8 is preferably at least about 10 mm. Preferably, the length of the cooling section 8 is at least about 15 mm. In some preferred embodiments, the length of the cooling section 8 is from about 15 mm to about 20 mm, more preferably from about 16 mm to about 19 mm. In the present example, the length of the cooling section 8 is 19 mm.

The cooling section 8 is located around and defines an air gap within the mouthpiece 2 which acts as a cooling section. The air gap provides a chamber through which heated volatilized components generated by the aerosol-generating material 3 flow. The cooling section 8 is hollow to provide a chamber for aerosol accumulation yet rigid enough to withstand axial compressive forces and bending moments that might arise during manufacture and whilst the article 1 is in use. The cooling section 8 provides a physical displacement between the aerosol-generating material 3 and the body of material 6. The physical displacement provided by the cooling section 8 will provide a thermal gradient across the length of the cooling section 8.

Preferably, the mouthpiece 2 comprises a cavity having an internal volume greater than 110 $mm^3$. Providing a cavity of at least this volume has been found to enable the formation of an improved aerosol. More preferably, the mouthpiece 2 comprises a cavity, for instance formed within the cooling section 8, having an internal volume greater than 110 $mm^3$, and still more preferably greater than 130 $mm^3$, allowing further improvement of the aerosol. In some examples, the internal cavity comprises a volume of between about 130 $mm^3$ and about 230 $mm^3$, for instance about 134 $mm^3$ or 227 $mm^3$.

The cooling section 8 can be configured to provide a temperature differential of at least 40 degrees Celsius between a heated volatilized component entering a first, upstream end of the cooling section 8 and a heated volatilized component exiting a second, downstream end of the cooling section 8. The cooling section 8 is preferably configured to provide a temperature differential of at least 60 degrees Celsius, preferably at least 80 degrees Celsius and more preferably at least 100 degrees Celsius between a heated volatilized component entering a first, upstream end of the cooling section 8 and a heated volatilized component exiting a second, downstream end of the cooling section 8. This temperature differential across the length of the cooling section 8 protects the temperature sensitive body of material 6 from the high temperatures of the aerosol-generating material 3 when it is heated.

The body of material 6 and hollow tubular element 4 each define a substantially cylindrical overall outer shape and share a common longitudinal axis. The body of material 6 is wrapped in a first plug wrap 7. Preferably, the first plug wrap 7 has a basis weight of less than 50 gsm, more preferably between about 20 gsm and 40 gsm. Preferably, the first plug wrap 7 has a thickness of between 30 μm and 60 μm, more preferably between 35 μm and 45 μm. Preferably, the first plug wrap 7 is a non-porous plug wrap, for instance having a permeability of less than 100 Coresta units, for instance less than 50 Coresta units. However, in other embodiments, the first plug wrap 7 can be a porous plug wrap, for instance having a permeability of greater than 200 Coresta Units.

Preferably, the length of the body of material 6 is less than about 15 mm. More preferably, the length of the body of material 6 is less than about 12 mm. In addition, or as an alternative, the length of the body of material 6 is at least about 5 mm. Preferably, the length of the body of material 6 is at least about 8 mm. In some preferred embodiments, the length of the body of material 6 is from about 5 mm to about 15 mm, more preferably from about 6 mm to about 12 mm, even more preferably from about 6 mm to about 12 mm, most preferably about 6 mm, 7 mm, 8 mm, 9 mm or 10 mm. In the present example, the length of the body of material 6 is 10 mm.

In the present example, the body of material 6 is formed from filamentary tow. In the present example, the tow used in the body of material 6 has a denier per filament (d.p.f) of 5 and a total denier of 25,000. In the present example, the tow comprises plasticized cellulose acetate tow. The plasticizer used in the tow comprises about 7% by weight of the tow. In the present example, the plasticizer is triacetin. In other examples, different materials can be used to form the body of material 6. For instance, rather than tow, the body 6 can be formed from paper, for instance in a similar way to paper filters known for use in cigarettes. Alternatively, the body 6 can be formed from tows other than cellulose acetate, for instance polylactic acid (PLA), other materials described herein for filamentary tow or similar materials. The tow is preferably formed from cellulose acetate. The tow, whether formed from cellulose acetate or other materials, preferably has a d.p.f. of at least 5. Preferably, to achieve a sufficiently uniform body of material 6, the tow has a denier per filament of no more than 12 d.p.f., preferably no more than 11 d.p.f. and still more preferably no more than 10 d.p.f.

The total denier of the tow forming the body of material 6 is preferably at most 30,000, more preferably at most 28,000 and still more preferably at most 25,000. These values of total denier provide a tow which takes up a reduced proportion of the cross sectional area of the mouthpiece 2 which results in a lower pressure drop across the mouthpiece 2 than tows having higher total denier values. For appropriate firmness of the body of material 6, the tow preferably has a total denier of at least 8,000 and more preferably at least 10,000. Preferably, the denier per filament is between 5 and 12 while the total denier is between 10,000 and 25,000. Preferably the cross-sectional shape of the filaments of tow are 'Y' shaped, although in other embodiments other shapes such as 'X' shaped filaments can be used, with the same d.p.f. and total denier values as provided herein.

Irrespective of the material used to form the body 6, the pressure drop across body 6, can, for instance, be between 0.3 and 5 mmWG per mm of length of the body 6, for instance between 0.5 mmWG and 2 mmWG per mm of length of the body 6. The pressure drop can, for instance, be between 0.5 and 1 mmWG/mm of length, between 1 and 1.5 mmWG/mm of length or between 1.5 and 2 mmWG/mm of length. The total pressure drop across body 6 can, for instance, be between 3 mmWG and 8 mWG, or between 4 mmWG and 7 mmWG. The total pressure drop across body 6 can be about 5, 6 or 7 mmWG.

As shown in FIG. 2, the mouthpiece 2 of the article 1 comprises an upstream end 2*a* adjacent to the rod of aerosol-generating material 3 and a downstream end 2*b* distal from the rod of aerosol-generating material 3. At the downstream end 2*b*, the mouthpiece 2 has a hollow tubular element 4 formed from filamentary tow. This has advantageously been found to significantly reduce the temperature of the outer surface of the mouthpiece 2 at the downstream end 2*b* of the mouthpiece which comes into contact with a consumer's mouth when the article 1 is in use. In addition, the use of the tubular element 4 has also been found to significantly reduce the temperature of the outer surface of the mouthpiece 2 even upstream of the tubular element 4. Without wishing to be bound by theory, it is hypothesized that this is due to the tubular element 4 channeling aerosol closer to the center of the mouthpiece 2, and therefore reducing the transfer of heat from the aerosol to the outer surface of the mouthpiece 2.

The "wall thickness" of the hollow tubular element 4 corresponds to the thickness of the wall of the tube 4 in a radial direction. This may be measured, for example, using a caliper. The wall thickness is advantageously greater than 0.9 mm, and more preferably 1.0 mm or greater. Preferably, the wall thickness is substantially constant around the entire wall of the hollow tubular element 4. However, where the wall thickness is not substantially constant, the wall thickness is preferably greater than 0.9 mm at any point around the hollow tubular element 4, more preferably 1.0 mm or greater. In the present example, the wall thickness of the hollow tubular element 4 is about 1.15 mm.

Preferably, the length of the hollow tubular element 4 is less than about 20 mm. More preferably, the length of the hollow tubular element 4 is less than about 15 mm. Still more preferably, the length of the hollow tubular element 4 is less than about 10 mm. In addition, or as an alternative, the length of the hollow tubular element 4 is at least about 5 mm. Preferably, the length of the hollow tubular element 4 is at least about 6 mm. In some preferred embodiments, the length of the hollow tubular element 4 is from about 5 mm to about 20 mm, more preferably from about 6 mm to about 10 mm, even more preferably from about 6 mm to about 8 mm, most preferably about 6 mm, 7 mm or about 8 mm. In the present example, the length of the hollow tubular element 4 is 7 mm.

Preferably, the density of the hollow tubular element 4 is at least about 0.25 grams per cubic centimeter (g/cc), more preferably at least about 0.3 g/cc. Preferably, the density of the hollow tubular element 4 is less than about 0.75 grams per cubic centimeter (g/cc), more preferably less than 0.6 g/cc. In some embodiments, the density of the hollow tubular element 4 is between 0.25 and 0.75 g/cc, more preferably between 0.3 and 0.6 g/cc, and more preferably between 0.4 g/cc and 0.6 g/cc or about 0.5 g/cc. These densities have been found to provide a good balance between improved firmness afforded by denser material and the lower heat transfer properties of lower density material. For the purposes of the present invention, the "density" of the hollow tubular element 4 refers to the density of the filamentary tow forming the element with any plasticizer incorporated. The density may be determined by dividing the total weight of the hollow tubular element 4 by the total volume of the hollow tubular element 4, wherein the total volume can be calculated using appropriate measurements of the hollow tubular element 4 taken, for example, using calipers. Where necessary, the appropriate dimensions may be measured using a microscope.

The filamentary tow forming the hollow tubular element 4 preferably has a total denier of less than 45,000, more preferably less than 42,000. This total denier has been found to allow the formation of a tubular element 4 which is not too dense. Preferably, the total denier is at least 20,000, more preferably at least 25,000. In preferred embodiments, the filamentary tow forming the hollow tubular element 4 has a total denier between 25,000 and 45,000, more preferably between 35,000 and 45,000. Preferably the cross-sectional shape of the filaments of tow are 'Y' shaped, although in other embodiments other shapes such as 'X' shaped filaments can be used.

The filamentary tow forming the hollow tubular element 4 preferably has a denier per filament of greater than 3. This denier per filament has been found to allow the formation of a tubular element 4 which is not too dense. Preferably, the denier per filament is at least 4, more preferably at least 5. In preferred embodiments, the filamentary tow forming the hollow tubular element 4 has a denier per filament between 4 and 10, more preferably between 4 and 9. In one example, the filamentary tow forming the hollow tubular element 4 has an 7.3Y36,000 tow formed from cellulose acetate and comprising 18% plasticizer, for instance triacetin.

The hollow tubular element 4 preferably has an internal diameter of greater than 3.0 mm. Smaller diameters than this can result in increasing the velocity of aerosol passing though the mouthpiece 2 to the consumers mouth more than is desirable, such that the aerosol becomes too warm, for instance reaching temperatures greater than 40° C. or greater than 45° C. More preferably, the hollow tubular element 4 has an internal diameter of greater than 3.1 mm, and still more preferably greater than 3.5 mm or 3.6 mm. In one embodiment, the internal diameter of the hollow tubular element 4 is about 3.9 mm.

The hollow tubular element 4 preferably comprises from 15% to 22% by weight of plasticizer. For cellulose acetate tow, the plasticizer is preferably triacetin, although other plasticizers such as polyethelyne glycol (PEG) can be used. More preferably, the tubular element 4 comprises from 16% to 20% by weight of plasticizer, for instance about 17%, about 18% or about 19% plasticizer.

In the present example, the first hollow tubular element 4, body of material 6 and second hollow tubular element 8 are combined using a second plug wrap 9 which is wrapped around all three sections. Preferably, the second plug wrap 9 has a basis weight of less than 50 gsm, more preferably between about 20 gsm and 45 gsm. Preferably, the second plug wrap 9 has a thickness of between 30 μm and 60 μm, more preferably between 35 μm and 45 μm. The second plug wrap 9 is preferably a non-porous plug wrap having a permeability of less than 100 Coresta Units, for instance less than 50 Coresta Units. However, in alternative embodiments, the second plug wrap 9 can be a porous plug wrap, for instance having a permeability of greater than 200 Coresta Units.

In the present example, the article 1 has an outer circumference of about 23 mm. In other examples, the article can be provided in any of the formats described herein, for instance having an outer circumference of between 15 mm and 25 mm. Since the article is to be heated to release an aerosol, improved heating efficiency can be achieved using articles having lower outer circumferences within this range, for instance circumferences of less than 23 mm. To achieve improved aerosol via heating, while maintaining a suitable product length, article circumferences of greater than 19 mm have also been found to be particularly effective. Articles having circumferences of between 19 mm and 23 mm, and more preferably between 20 mm and 22 mm, have been found to provide a good balance between providing effective aerosol delivery while allowing for efficient heating.

The article has a ventilation level of about 10% of the aerosol drawn through the article. In alternative embodiments, the article can have a ventilation level of between 1% and 20% of aerosol drawn through the article, for instance between 1% and 12%. Ventilation at these levels helps to increase the consistency of the aerosol inhaled by the user at the mouth end 2*b*, while assisting the aerosol cooling process. The ventilation is provided directly into the mouthpiece 2 of the article 1. In the present example, the ventilation is provided into the cooling section 8, which has been found to be particularly beneficial in assisting with the aerosol generation process. The ventilation is provided via perforations 12, in the present case formed as a single row of laser perforations, positioned 13 mm from the downstream, mouth-end 2*b* of the mouthpiece 2. In alternative embodiments, two or more rows of ventilation perforations may be provided. These perforations pass though the tipping paper 5, second plug wrap 9 and cooling section 8. In alternative embodiments, the ventilation can be provided into the mouthpiece at other locations, for instance into the body of material 6 or first tubular element 4. Preferably, the article is configured such that the perforations are provided about 28 mm or less from the upstream end of the article 1, preferably between 20 mm and 28 mm from the upstream end of the article 1. In the present example, the apertures are provided about 25 mm from the upstream end of the article.

Figure 2A:
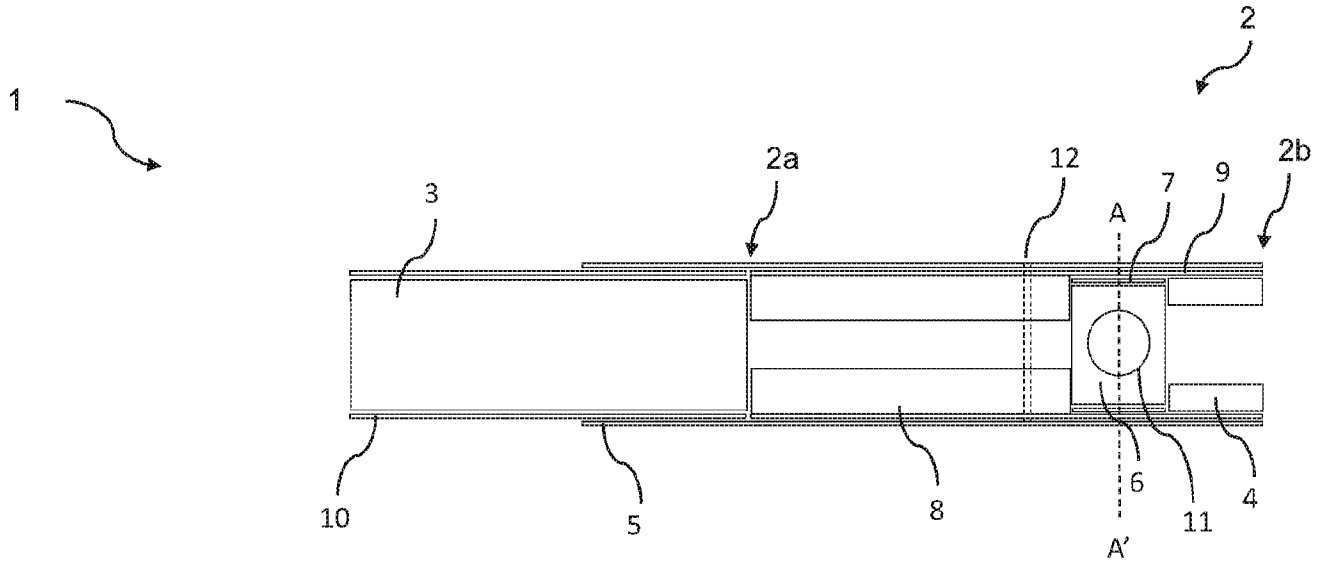
FIG. 2*a* is a side-on cross sectional view of a further article for use with a non-combustible aerosol provision device, in this example the article including a capsule-containing mouthpiece.
Figure 2B:
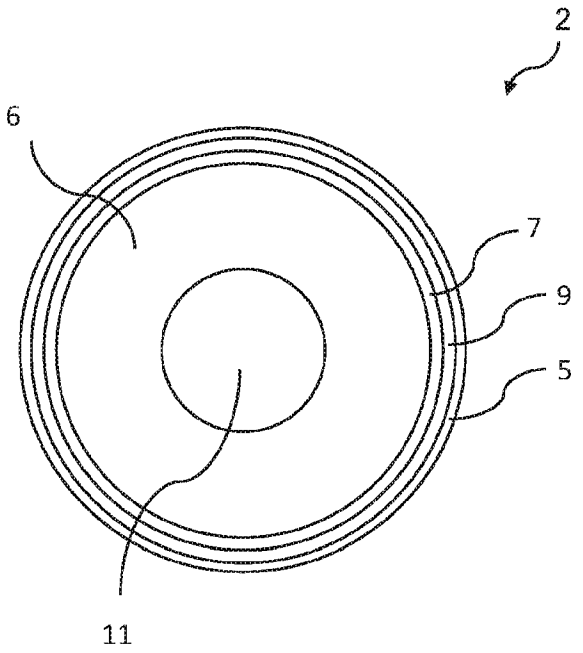
FIG. 2*b* is a cross sectional view of the capsule-containing mouthpiece shown in FIG. 2*a;*

FIG. 2*a* is a side-on cross sectional view of a further article 1' including a capsule-containing mouthpiece 2'. FIG. 2*b* is a cross sectional view of the capsule-containing mouthpiece shown in FIG. 2*a* through the line A-A' thereof. Article 1' and capsule-containing mouthpiece 2' are the same as the article 1 and mouthpiece 2 illustrated in FIG. 2, except that an aerosol modifying agent is provided within the body of material 6, in the present example in the form of a capsule 11, and that an oil-resistant first plug wrap 7' surrounds the body of material 6. In other examples, the aerosol modifying agent can be provided in other forms, such as material injected into the body of material 6 or provided on a thread, for instance the thread carrying a flavorant or other aerosol modifying agent, which may also be disposed within the body of material 6.

The capsule 11 can comprise a breakable capsule, for instance a capsule which has a solid, frangible shell surrounding a liquid payload. In the present example, a single capsule 11 is used. The capsule 11 is entirely embedded within the body of material 6. In other words, the capsule 11 is completely surrounded by the material forming the body 6. In other examples, a plurality of breakable capsules may be disposed within the body of material 6, for instance 2, 3 or more breakable capsules. The length of the body of material 6 can be increased to accommodate the number of capsules required. In examples where a plurality of capsules is used, the individual capsules may be the same as each other, or may differ from one another in terms of size and/or capsule payload. In other examples, multiple bodies of material 6 may be provided, with each body containing one or more capsules.

The capsule 11 has a core-shell structure. In other words, the capsule 11 comprises a shell encapsulating a liquid agent, for instance a flavorant or other agent, which can be any one of the flavorants or aerosol modifying agents described herein. The shell of the capsule can be ruptured by a user to release the flavorant or other agent into the body of material 6. The first plug wrap 7' can comprise a barrier coating to make the material of the plug wrap substantially impermeable to the liquid payload of the capsule 11. Alternatively or in addition, the second plug wrap 9 and/or tipping paper 5 can comprise a barrier coating to make the material of that plug wrap and/or tipping paper substantially impermeable to the liquid payload of the capsule 11.

In the present example, the capsule 11 is spherical and has a diameter of about 3 mm. In other examples, other shapes and sizes of capsule can be used. For example, the capsule may have a diameter less than 4 mm, or less than 3.5 mm, or less than 3.25 mm. In alternative embodiments, the capsule may have a diameter greater than about 3.25 mm, for example greater than 3.5 mm, or greater than 4 mm. The total weight of the capsule 11 may be in the range about 10 mg to about 50 mg.

In the present example, the capsule 11 is located at a longitudinally central position within the body of material 6. That is, the capsule 11 is positioned so that its center is 5 mm from each end of the body of material 6. In the present example, the center of the capsule is positioned 36 mm from the upstream end of the article 1. Preferably, the capsule is positioned between 28 mm and 38 mm from the upstream end of the article 1, more preferably between 34 mm and 38 mm from the upstream end of the article 1. In the present example, the capsule is positioned 12 mm from the downstream end of the mouthpiece 2*b*. Providing a capsule at this position results in improved volatilization of the capsule contents, due to the proximity of the capsule to the aerosol-generating section of the article which is heated in use, whilst also being far enough from the aerosol-generating section which, in use, is inserted into an aerosol provision system, to enable the user to readily access the capsule and burst it with their fingers.

In other examples, the capsule 11 can be located at a position other than a longitudinally central position in the body of material 6, i.e. closer to the downstream end of the body of material 6 than the upstream end, or closer to the upstream end of the body of material 6 than the downstream end. Preferably, the mouthpiece 2' is configured so that the capsule 11 and the ventilation holes 12 are longitudinally offset from each other in the mouthpiece 2'. For example, the ventilation holes 12 may be provided immediately upstream of the capsule position, i.e. between about 1 mm and about 10 mm upstream of the capsule position.

In the present embodiment, the moisture impermeable wrapper 10 which circumscribes the rod of aerosol-generating material comprises aluminum foil. In other embodiments, the wrapper 10 comprises a paper wrapper, optionally comprising a barrier coating to make the material of the wrapper substantially moisture impermeable. Aluminum foil has been found to be particularly effective at enhancing the formation of aerosol within the aerosol-generating material 3. In the present example, the aluminum foil has a metal layer having a thickness of about 6 μm. In the present example, the aluminum foil has a paper backing. However, in alternative arrangements, the aluminum foil can be other thicknesses, for instance between 4 μm and 16 μm in thickness. The aluminum foil also need not have a paper backing, but could have a backing formed from other materials, for instance to help provide an appropriate tensile strength to the foil, or it could have no backing material. Metallic layers or foils other than aluminum can also be used. The total thickness of the wrapper is preferably between 20 μm and 60 μm, more preferably between 30 μm and 50 μm, which can provide a wrapper having appropriate structural integrity and heat transfer characteristics. The tensile force which can be applied to the wrapper before it breaks can be greater than 3,000 grams force, for instance between 3,000 and 10,000 grams force or between 3,000 and 4,500 grams force. Where the wrapper comprises paper or a paper backing, i.e. a cellulose based material, the wrapper can have a basis weight greater than about 30 gsm, preferably greater than about 40 gsm, more preferably greater than about 50 gsm. The inventors have advantageously found such basis weights provide an improved rigidity to the rod of aerosol-generating material. The improved rigidity provided by wrappers having a basis weight greater than 30 about gsm, greater than about 40 gsm, or greater than about 50 gsm, can make the rod of aerosol-generating material 3 more resistant to crumpling or other deformation under the forces to which the article is subject, in use, for example when the article is inserted into a device and/or a heat generator is inserted into the article, without.

Providing a rod of aerosol-generating material having increased rigidity can be beneficial where a cooling section 8 is included in the article 1, since where a cooling section 8 has an internal diameter less than about 4 mm, as described herein, the insertion force required to insert the article into a device and/or to insert an aerosol generator into the article can be increased. The improved rigidity of the rod of aerosol-generating material allows the article to withstand the increased forces to which the article is subject, in use.

In the present example, the moisture impermeable wrapper 10 is also substantially impermeable to air. In alternative embodiments, the wrapper 10 preferably has a permeability of less than 100 Coresta Units, more preferably less than 60 Coresta Units. It has been found that low permeability wrappers, for instance having a permeability of less than 100 Coresta Units, more preferably less than 60 Coresta Units, result in an improvement in the aerosol formation in the aerosol-generating material 3. Without wishing to be bound by theory, it is hypothesized that this is due to reduced loss of aerosol compounds through the wrapper 10. The permeability of the wrapper 10 can be measured in accordance with ISO 2965:2009 concerning the determination of air permeability for materials used as cigarette papers, filter plug wrap and filter joining paper.

The aerosol-generating section comprises an aerosol-generating material, as described herein. The aerosol-generating material may comprise a plurality of strands or strips of aerosol-generating material. For example, the aerosol-generating material may comprise a plurality of strands or strips of the aerosolizable material and/or a plurality of strands or strips of the amorphous solid. In some embodiments, the aerosol-generating material consists of a plurality of strands or strips of the aerosolizable material.

The plurality of strands or strips of aerosol-generating material may be aligned within the aerosol-generating section such that their longitudinal dimension is in parallel alignment with the longitudinal axis, X-X' of the article 1. Alternatively, the strands or strips may generally be arranged such that their longitudinal dimension aligned is transverse to the longitudinal axis of the article.

At least about 10%, 20%, 30%, 40%, 50%, 60%, 70%, 80%, 90% or 95% of the plurality of strands or strips may be arranged such that their longitudinal dimension in parallel alignment with the longitudinal axis of the of the article. A majority of the strands or strips may be arranged such that their longitudinal dimensions in parallel alignment with the longitudinal axis of the article. In some embodiments, about 95% to about 100% of the plurality of strands or strips are arranged such that their longitudinal dimension is in parallel alignment with the longitudinal axis of the article. In some embodiments, substantially all of the strands or strips are arranged in the aerosol-generating section such that their longitudinal dimension is in parallel alignment with the longitudinal axis of the aerosol-generating section of the article.

The inventors have found that, where the majority of the strands or strips are arranged in the aerosol-generating section such that their longitudinal axis is parallel with the longitudinal axis of the aerosol-generating section of the article, the force required to insert an aerosol generator into the aerosol-generating material may be relatively low. This may mean that the article is easier to use.

The longitudinal dimension of the plurality of strands or strips may be substantially the same as a length of the aerosol-generating section. The plurality of strands and/or strips may have a length of at least about 5 mm.

As noted above, optionally, the aerosol-generating material comprises a plurality of strips of amorphous solid material. Where the aerosol-generating section comprises a plurality of strands and/or strips of the sheet of aerosolizable material and a plurality of strips of amorphous solid material, the material properties and/or dimensions of the at least two components may be suitably selected in other ways, to ensure a relatively uniform mix of the components is possible, and to reduce separation or un-mixing of the components during or after manufacture of the rod of aerosol-generating material.

When in use, the aerosol-generating section may exhibit a pressure drop of from about 15 to about 40 mm $H_2O$. In some embodiments, the aerosol-generating section exhibits a pressure drop across the aerosol-generating section of from about 15 to about 30 mm $H_2O$.

The aerosol-generating material may have a packing density of between about 400 mg/cm$^3$ and about 900 mg/cm$^3$ within the aerosol-generating section. A packing density higher than this may make it difficult to insert the aerosol-generator of the aerosol provision device into the aerosol-generating material and increase the pressure drop. A packing density lower than 400 mg/cm$^3$ may reduce the rigidity of the article. Furthermore, if the packing density is too low, the aerosol-generating material may not effectively grip the aerosol-generator of the aerosol provision.

At least about 70% of a volume of the aerosol-generating section is filled with the aerosol-generating material. In some embodiments, from about 75% to about 85% of the volume of the cavity is filled with the aerosol-generating material.

The article may be for use in a non-combustible aerosol provision device comprising an aerosol generator for insertion into the aerosol-generating material/consumable.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

Figure 3:
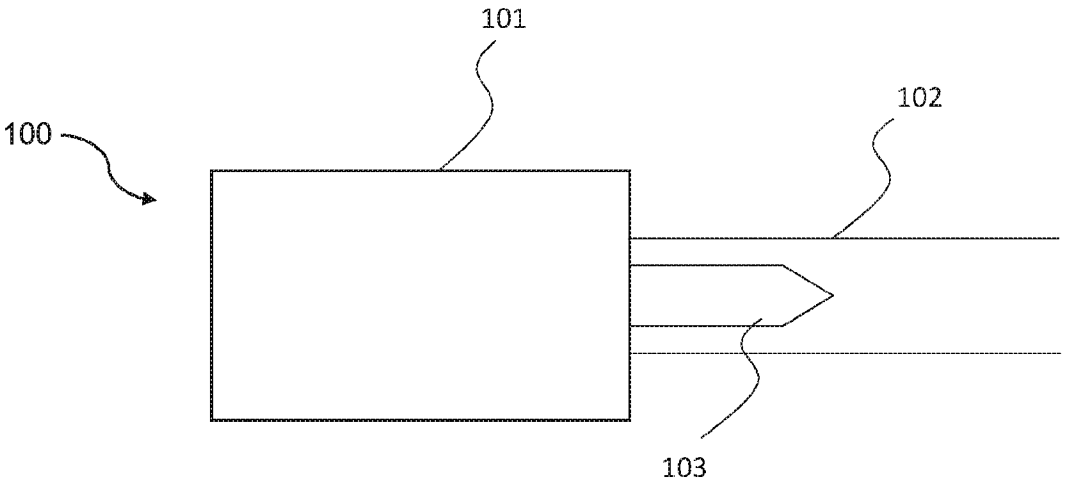
FIG. 3 is a cross-sectional view of the non-combustible aerosol provision device comprising an aerosol-generator.

In FIG. 3, the components of an embodiment of a non-combustible aerosol provision device 100 are shown in a simplified manner. Particularly, the elements of the non-combustible aerosol provision device 100 are not drawn to scale in FIG. 3. Elements that are not relevant for the understanding of this embodiment have been omitted to simplify FIG. 3.

As shown in FIG. 3, the non-combustible aerosol provision device 100 comprises a non-combustible aerosol-provision device having a housing 101 comprising an area 102 102 for receiving an article 1.

The area 102 is arranged to receive the article 1. When the article 1 is received into the area 102, at least a portion of the aerosol-generating material comes into thermal proximity with the heater 103. When the article 1 is fully received in the area 102, at least a portion of the aerosol-generating material may be in direct contact with the heater 103. The aerosol-generating material may release a range of volatile compounds at different temperatures. By controlling the maximum operation temperature of the electrically heated aerosol-generating system 100, the selective release of undesirable compounds may be controlled by preventing the release of select volatile compounds.

Figure 4:
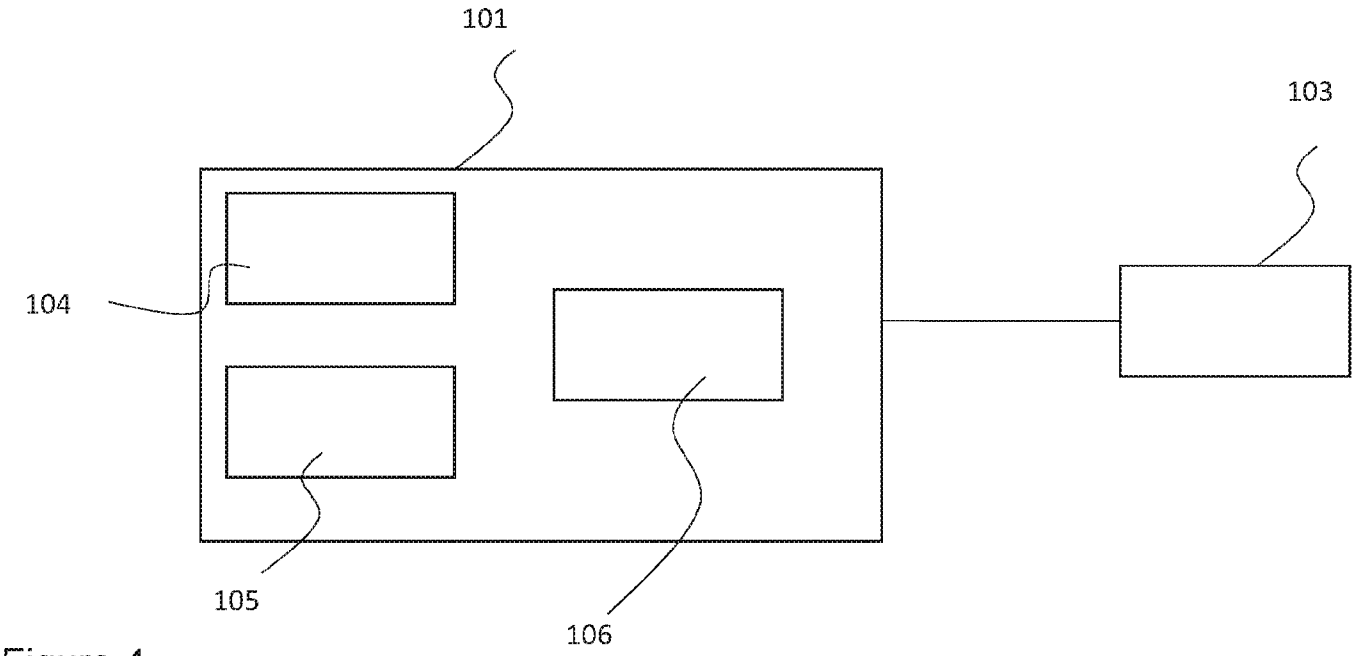
FIG. 4 is a schematic of the non-combustible aerosol-provision device shown in FIG. 3.

As shown in FIG. 4, within the housing 101 there is an electrical energy supply 104, for example a rechargeable lithium ion battery. A controller 105 is connected to the heater 103, the electrical energy supply 104, and a user interface 106, for example a button or display. The controller 105 controls the power supplied to the heater 103 in order to regulate its temperature. Typically the aerosol-forming substrate is heated to a temperature of between 250 and 450 degrees centigrade.

Figure 5:
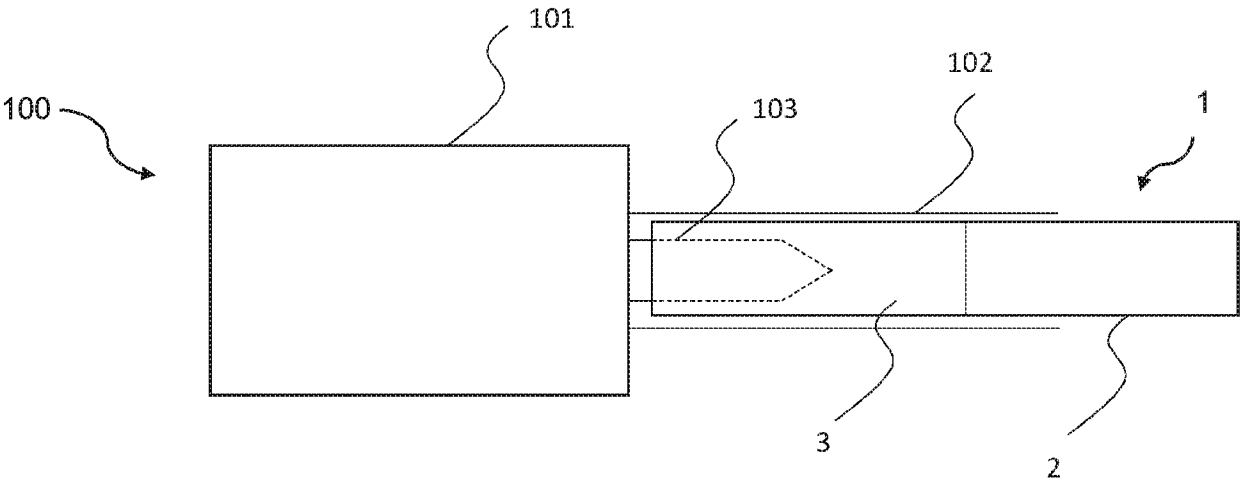
FIG. 5 is a cross-sectional view of the non-combustible aerosol provision device shown in FIG. 3 in engagement with the article shown in FIG. 2.

FIG. 5 is a schematic cross-section of a non-combustible aerosol-provision device of the type shown in FIG. 3, with the heater 103 inserted into the aerosol-generating material 3 of an article 1. The non-combustible aerosol provision device is illustrated in engagement with the aerosol-generating article 1 for consumption of the aerosol-generating article 1 by a user.

The housing 101 of non-combustible aerosol provision device defines an area 102 in the form of a cavity, open at the proximal end (or mouth end), for receiving an aerosol-generating article 1 for consumption. The distal end of the cavity is spanned by a heating assembly comprising a heater 103. The heater 103 is retained by a heater mount (not shown) such that an active heating area of the heater is located within the cavity. The active heating area of the heater 103 is positioned within the aerosol-generating section of the aerosol-generating article 1 when the aerosol-generating article 1 is fully received within the cavity.

The heater 103 is configured for insertion into the aerosol-generating material 3. The heater 103 is shaped in the form of a blade terminating in a point. That is, the heater has a length dimension that is greater than its width dimension, which is greater than its thickness dimension. First and second faces of the heater are defined by the width and length of the heater.

As the article 1 is pushed into the cavity, the tapered point of the heater engages with the aerosol-generating material 3. The blade is shaped for easy insertion and removal from an aerosol-generating material 3. By applying a force to the article 1, the heater penetrates into the aerosol-generating material 3. When the article 1 is properly engaged with the non-combustible aerosol provision device, the heater 103 is inserted into the aerosol-generating material 3. When the heater is actuated, aerosol-generating material 3 is warmed and volatile substances are generated or evolved. As a user draws on the mouthpiece 2, air is drawn into the article 1 and the volatile substances condense to form an inhalable aerosol. This aerosol passes through the mouthpiece 2 of the article 1 and into the user's mouth.

The inventors have found that, the aerosol generator can be inserted into the aerosolizable material with relative ease. Furthermore, once the aerosol generator is inserted into the aerosolizable material, the article securely retained. This makes the article and device easier to use and also safer because the article may be less likely to become displaced from the aerosol generator during use. For example, in some embodiments, insertion of the aerosol generator into the aerosol-generating section of the article requires a force of less than about 100 N, less than about 90 N, less than about 80 N, less than about 70 N or less than about 60 N. The amount of force required to remove the article from the device can be at least about 1.9 N, at least about 2 N, at least about 2.1 N, at least about 2.2. N, at least about 2.3 N, at least about 2.4 N, at least about 2.5 N, at least about 2.6 N, at least about 2.7 N, at least about 2.8 N, at least about 2.9 N or at least about 3 N. In some embodiments, the amount of force required to remove the article from the device can be less than 1 N. For example, the amount of force required to remove the article from the device can be between about 0.1 N and 0.8 N.

EXAMPLES

Example 1

The effect that the inclusion of stem in a sheet of aerosolizable material has on the burst strength of the sheet was investigated using a calibrated Texture Analyzer (50 kg load cell, 20 mm probe height calibration, 1 g contact force) and Exponent software, made by (Stable Micro Systems). The burst strength was determined using a 3 $cm^2$ sheet of aerosolizable material using a 5 mm stainless steel ball probe. The results are shown in Table 1.

TABLE 1

| | Shredded Aerosolizable Sheet 1 | Shredded Aerosolizable Sheet 2 |
|---|---|---|
| Lamina (%) | 73 | 60.8 |
| Binder (%) | 4 | 4 |
| Fiber (%) | 6 | 6 |
| Glycerol (%) | 17 | 17 |
| Stem (%) | 0 | 12.2 |
| Burst Strength (g) | 152 | 197 |
| Area density ($g/m^2$) | 170 | 181 |
| Thickness (mm) | 218 | 251 |

As can be see, including stem increased the burst strength of the sheet of aerosolizable material.

Example 2

Ten articles (Articles 1-10) for use in a non-combustible aerosol-provision device were manufactured using either Shredded Aerosolizable Sheet 1, "Composition 1", or Shredded Aerosolizable Sheet 2, "Composition 2" (from Example 1). The sheets were formed into an aerosol-generating section of ten rod-shaped articles. Each article had a total length of 48 mm and a roundness of at least 98%.

The forces required to insert and withdraw each article into a Philip Morris IQOS device were then analyzed using a calibrated Texture Analyzer and Exponent software made by (Stable Micro Systems). The results are shown in Table 2.

TABLE 2

| Article | Composition | Inner Diameter (mm) | Average Mass of Aerosolizable Material (mg) | Insertion Force (g) | Withdrawal Force (g) |
|---|---|---|---|---|---|
| Comparative article* | N/A | 3 | ~300 | 4680.3 | 181.5 |
| 1 | 1 | 3.9 | 296 | 7846.6 | 330.1 |
| 2 | 1 | 3.9 | 292 | 8584.6 | 285.4 |
| 3 | 1 | 3 | 280 | 5405.0 | 238.7 |
| 4 | 1 | 3 | 283 | 6172.7 | 244.5 |
| 5 | 1 | 3.9 | 299 | 7658.8 | 306.3 |
| 6 | 1 | 3 | 284 | 7137.8 | 293.6 |
| 7 | 1 | 3.9 | 288 | 6574.8 | 258.7 |
| 8 | 1 | 3.9 | 298 | 7596.2 | 350.1 |
| 9 | 1 | 3 | 285 | 8452.1 | 284.4 |
| 10 | 2 | 3 | 299 | 5485.6 | 220.1 |

*Philip Morris Heets Amber (crimped)

The results show that the force required to insert the aerosol generator into the tobacco material was higher for Articles 1 to 10 than the Comparative Article. However, the amount of force required to remove Articles 1-10 was greater than the Comparative Article.

Example 3

The effect that the presence and quantity of binder and filler has on the tensile strength of the sheet was investigated. Two sheets of aerosolizable material having different levels of binder (guar gum) and filler (wood pulp, non-sulphur treated) were prepared and the results are shown in Table 3.

The tensile strength of each sheet was analyzed using a calibrated Texture Analyzer and Exponent software (Stable Micro Systems). The analyzer was calibrated with a return distance of 40 mm, a return speed of 5 mm/s and a contact force of 0.1 g. The sheets had a width of 15 mm and a length of 140 mm. 25 mm of each sheet was folded over at each end. Once folded in this way, the sheets had a total length of 90 mm with a 40 mm single thickness section in the center.

TABLE 3

| Aerosolizable Material | Lamina (%) | Binder (%) | Filler (%) | Glycerol (%) | Stem (%) | Tensile strength (N/15 mm) |
|---|---|---|---|---|---|---|
| Low Binder Fiber | 68 | 2 | 3 | 17 | 10 | 4.10 |
| Medium Binder Fiber | 63 | 4 | 6 | 17 | 10 | 6.72 |

As can be seen, increasing the amount of binder and filler in the sheet increases its tensile strength.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. An aerosol-generating material comprising a sheet or shredded sheet of aerosolizable material comprising tobacco material, an aerosol-former material and a binder, wherein the sheet or shredded sheet has a thickness of at least about 100 μm and an area density of from about 100 $g/m^2$ to about 250 $g/m^2$, wherein the tobacco material comprises stem tobacco and lamina tobacco, wherein the stem tobacco is present in an amount of 10% to 55% by weight of the aerosolizable material and the lamina tobacco is present in an amount of 45% to 90% by weight of the aerosolizable material.

2. An aerosol-generating material as claimed in claim 1, wherein the sheet or the shredded sheet of aerosolizable material has an average thickness of from about 160 μm and about 290 μm.

3. An aerosol-generating material as claimed in claim 1 wherein the sheet or the shredded sheet of aerosolizable material has a tensile strength of at least about 4 N/15 mm and/or a burst strength of at least about 75 g.

4. An aerosol-generating material as claimed in claim 1, wherein the shredded sheet of aerosolizable material comprises a plurality of strands or strips of the aerosolizable material, optionally wherein the strands or strips of aerosolizable material have a width of between about 0.9 mm and about 2 mm.

5. An aerosol-generating material as claimed in claim 1, wherein the sheet or shredded sheet of aerosolizable material comprises water and the aerosol-former material in a total amount of less than about 30% by weight of the aerosolizable material.

6. An aerosol-generating material as claimed in claim 1, wherein the aerosol-former material is present in an amount of from about 10% to about 25% by weight of the aerosolizable material.

7. An aerosol-generating material as claimed in claim 1, wherein the tobacco material comprises particulate tobacco, wherein a population of the particulate tobacco has a particle size distribution (D90) of at least about 100 μm.

8. An aerosol-generating material as claimed in claim 1, wherein the aerosolizable material comprises a filler, optionally wherein the filler comprises a fibrous material, optionally wherein the fibrous material comprises wood fibers.

9. An aerosolizable material comprising tobacco material, an aerosol-former material and a binder, wherein the sheet or shredded sheet has a thickness of at least about 100 μm and an area density of from about 100 $g/m^2$ to about 250 $g/m^2$, wherein the tobacco material comprises stem tobacco and lamina tobacco, wherein the stem tobacco is present in an amount of 10% to 55% by weight of the aerosolizable material and the lamina tobacco is present in an amount of 45% to 90% by weight of the aerosolizable material, optionally wherein the aerosolizable material is not crimped.

* * * * *